United States Patent [19]

Krajicek et al.

[11] Patent Number: 4,945,933

[45] Date of Patent: Aug. 7, 1990

[54] LIQUID CIRCULATOR USEFUL FOR DISPERSING SEDIMENT CONTAINED IN A STORAGE TANK

[75] Inventors: Richard W. Krajicek, Houston, Tex.; Robert R. Cradeur, Sulphur, La.

[73] Assignee: Serv-Tech, Inc., Houston, Tex.

[21] Appl. No.: 180,334

[22] Filed: Apr. 11, 1988

[51] Int. Cl.[5] ..... B08B 3/02

[52] U.S. Cl. ..... 134/167 R; 134/169 R; 134/180; 134/198; 239/753; 239/264

[58] Field of Search ..... 134/166 R, 167 R, 169 R, 134/180, 181, 198, 200; 239/753, 264

[56] References Cited

U.S. PATENT DOCUMENTS

| | | | |
|---|---|---|---|
| 1,928,621 | 10/1933 | Frede et al. | 134/181 UX |
| 1,978,015 | 10/1934 | Erdman . | |
| 2,116,935 | 5/1938 | Richard . | |
| 2,647,639 | 8/1953 | Grein | 210/207 |
| 2,661,241 | 12/1953 | Veneziano | 134/181 X |
| 2,845,091 | 7/1958 | Neer . | |
| 2,917,242 | 12/1959 | Waldrum | 239/264 X |
| 3,001,534 | 9/1961 | Grant, Jr. | 134/181 X |
| 3,042,553 | 7/1962 | Kearney et al. . | |
| 3,077,306 | 2/1963 | Herzog | 239/264 X |
| 3,121,027 | 2/1964 | Galanor | 134/10 |
| 3,408,006 | 10/1969 | Stanwood | 4/172 |
| 3,449,772 | 6/1969 | Werner . | |
| 3,586,294 | 6/1971 | Strong . | |
| 3,675,252 | 7/1972 | Ghiz | 4/172.17 |
| 3,834,625 | 9/1974 | Barthod-Malat | 239/264 X |
| 3,878,857 | 4/1975 | Heibo . | |
| 3,953,266 | 4/1976 | Emond et al. . | |
| 4,214,705 | 7/1980 | Watts et al. . | |
| 4,244,524 | 1/1981 | Wellings | 134/181 X |
| 4,289,152 | 9/1981 | Sable | 134/167 |
| 4,347,979 | 9/1982 | Matthews | 239/206 |
| 4,407,678 | 8/1983 | Furness et al. | 134/22.18 |
| 4,429,429 | 2/1984 | Altschul | 15/50 |
| 4,558,479 | 12/1985 | Greskovics et al. | 15/1.7 |
| 4,685,947 | 4/1987 | Furness et al. | 134/22.18 |
| 4,716,917 | 1/1988 | Schmidt | 134/181 X |

FOREIGN PATENT DOCUMENTS

| | | |
|---|---|---|
| 8706489.8 | 5/1987 | Fed. Rep. of Germany . |
| 8218117 | 10/1982 | France . |

OTHER PUBLICATIONS

Taiho, "The Crude Oil Washing Process"—Jan. 1985.

*Primary Examiner*—Frankie L. Stinson
*Attorney, Agent, or Firm*—Kirk, Bissex & Lindsay

[57] ABSTRACT

A method and apparatus for cleaning the interior of storage tanks of the type used for storing large volumes of liquids, such as crude oil, wherein hydrocarbon sludge accumulates with the passage of time, such apparatus comprising a hollow housing, liquid agitation means including a plurality of nozzled outlet jets laterally rotatably mounted on the housing in fluid communication with the hollow interior thereof, connecting means comprising an independently rotatable tubular casing rotatably mounted on the housing in fluid communication with the interior thereof, the tubular casing having a kelly mounted therein and being operatively connected with the nozzled outlet jets, and multi-joint support pipe means rotatably joined to the connecting means in fluid communication with the interior of the tubular casing.

With this construction, an appropriate pump means may be provided for forcing a liquid, such as crude oil through the multi-joint support pipe means into the hollow housing and out of the hollow housing through the nozzled outlet jets and indexing power means may suitably be provided and operatively rotatably connected to the laterally rotatable outlet jets for their rotation at a predetermined rate independent of the rate of flow of liquid through the nozzled outlet jets.

21 Claims, 6 Drawing Sheets

LIQUID CIRCULATOR USEFUL FOR DISPERSING SEDIMENT CONTAINED IN A STORAGE TANK

BACKGROUND OF THE INVENTION

1. Technical Field of the Invention

This invention relates to a novel method and apparatus for the dispersion of sediment, such as hydrocarbon sludge in a storage tank. More particularly, this invention relates to a method and apparatus for cleaning the interior of hydrocarbon storage tanks of the type used in petroleum refineries, chemical plants and the like for storing large volumes of hydrocarbon liquids, wherein solid materials (composed principally of hydrocarbons) and normally referred to as "hydrocarbon sludge" accumulate with the passage of time.

Still more particularly, this invention relates to novel apparatus for dispersing accumulated sediments, such as hydrocarbon sludge, in a storage tank, such apparatus comprising a hollow housing, liquid agitation means including a plurality of nozzled outlet jets laterally rotatably mounted on the housing in fluid communication with the hollow interior thereof, connecting means comprising an independently rotatable tubular casing rotatably mounted on the housing in fluid communication with the interior thereof, the tubular casing having casing turning means, such as a kelly, mounted therein and having casing turning means mounted thereon and being operatively connected with the nozzled outlet jets, and multi-joint support pipe means rotatably jointed to the connecting means in fluid communication with the interior of the tubular casing.

With this construction, an appropriate pump means may be provided for forcing a liquid, such as a liquid hydrocarbon through the multi-joint support pipe means and the tubular connecting means into the hollow housing and out of the hollow housing through the nozzled outlet jets and indexing power means may suitably be provided and operatively connected with the laterally rotatable outlet jets in a manner to be described in order to laterally rotate the nozzled outlet jets at a predetermined rate independent of the rate of flow of liquid through the nozzled outlet jets.

In a preferred embodiment, the liquid circulator will also comprise an elongate sled and the hollow housing will be pivotally mounted on the sled adjacent the front end thereof. The mass of the sled should be greater than the mass of a combination of the hollow housing, the liquid agitating means and the connecting means so that the center of gravity of the sled and the said combination mounted thereon is below the lateral axis of the opening in the housing and the tubular connecting means mounted thereon. As a consequence the liquid agitation means will always be in an upright position.

In accordance with one embodiment of the present invention, a gate valve and an isolation barrel are fixed to a manway in the side of a storage tank, such as a storage tank of the type used to store crude oil. Representative crude oil storage tanks have a diameter of about 100 to about 300 feet and a height of about 20 to about 50 feet. Hydrocarbon sludge will settle from the stored crude oil with the passage of time such that the bottom of a crude oil storage tank may contain an accumulation of about 1 to about 10 feet of hydrocarbon sludge in the bottom of the crude oil storage tank. In accordance with this embodiment of the present invention, an isolation barrel is mounted on the gate valve, the isolation barrel being provided with a valve-controlled drain line in the side thereof and a tubular packing gland in the closed rear end thereof. With the gate valve closed, a crude oil circulator of the present invention may be placed in the isolation barrel. After the crude oil circulator is positioned in the isolation barrel and the isolation barrel is mounted on the gate valve, the gate valve may be opened and crude oil in the storage tank will flow into the isolation barrel. The first joint of pipe connected to the laterally nozzled hydrocarbon sludge circulator will suitably contain a rotatable kelly rod or other suitable interconnective turning means. A plurality of additional joints of pipe, each of which contains interconnective turning means is sequentially coupled to the first joint of pipe and pushed through the packing gland of the isolation barrel, thereby progressively forcing the crude oil circulator into the crude oil storage tank. When the crude oil circulator has been forced into the storage tank a desired distance, a connecting rod is coupled to the interconnective turning means.

In further accordance with this embodiment, the valved drain line of the isolation barrel is fluidly interconnected with a suitable filter means which is, in turn, fluidly interconnected with the suction side of a high pressure liquid pump. The discharge side of the high pressure liquid pump is fluidly interconnected with the plurality of joints of pipe coupled to the liquid (crude oil) circulator. Indexing power means are operatively interconnected with the connecting rod. With this arrangment, operation of the high pressure liquid pump will cause a stream of crude oil to be drawn from the isolation barrel through the drain line to the filter means, and after filtration, to the suction side of the high pressure liquid pump. The crude oil will be pressured in the pump and discharged therefrom through the joints of pipe back to the liquid circulator and out the nozzled outlet jets into the storage tank.

Simultaneous operation of the indexing power means will rotate the connecting rod which will rotate the interconnective turning means and the casing turning means in the connecting means. As a consequence, the tubular housing and the nozzle drive means will rotate and thereby rotate the nozzled outlet jets. The resultant agitation of the crude oil in the storage tank will cause the sediment in the tank to be dispersed therein for passage from the storage tank through the isolation barrel to the filter means.

In another aspect, the present invention is directed to a method for the dispersion of hydrocarbon sludge in crude oil stored in a crude oil storage tank, in order to clean the crude oil storage tank, the method including the steps of injecting a stream of the crude oil into the hydrocarbon sludge at a velocity of about 10,000 to about 20,000 gallons per minute to thereby disperse the hydrocarbon sludge in the crude oil while agitating the crude oil in order to maintain the dispersed hydrocarbon sludge in suspension, withdrawing a stream of crude oil containing dispersed hydrocarbon sludge from the crude oil storage tank, filtering the withdrawn suspension, pressuring the filtered crude oil and reinjecting the crude oil under pressure into the crude oil storage tank at the desired velocity.

Additional modifications, embodiments and advantages of the present invention will be hereinafter described in greater detail.

2. Prior Art

Furness et al. U. S. Pat. No. 4,407,678 discloses a sludge removal machine for removing sludge from the bottom of a storage tank which comprises a hollow body, and laterally rotatable nozzles. The sludge removal machine is suspended in a storage tank from a pipe through which a cleaning liquid may be pumped. The sludge removal machine is also provided with a "turbine" or impeller for rotating the nozzles in order to disperse sludge.

Furness et al. U. S. Pat. No. 4,685,974 is directed to a method for removing settled sludge from the bottom of a storage tank which uses apparatus of the type disclosed and claimed in Furness et al. U. S. Pat. No. 4,407,678. In accordance with the method of Furness et al., a liquid such as crude oil is pumped into a machine suspended in a storage tank adjacent a side wall thereof and which is provided with diametrically opposed lateral nozzles which are rotated in a manner such that each nozzle emits liquid during 180° of its rotation to avoid impingement of liquid on the side of the tank wall to thereby suspend the sledge in the liquid in the tank after which the liquid having sludge suspended therein is pumped from the tank.

Strong U. S. Pat. No. 3,586,294 is directed to a method and apparatus for creating a suspension of fine particles in a liquid in a tank using a plurality of spargers suspended above the bottom of the tank on a nonrotating lattice of feed pipes through which a liquid is pumped for emission through the sparging nozzles to suspend fine particles of sediment in the liquid for discharge from the tank on removal of the suspension.

Erdman U. S. Pat. No. 1,978,615 is directed to method and apparatus for cleaning sediment from a tank containing a fluid comprising a central manifold from which a plurality of discharge pipes radiate, each discharge pipe being provided with a plurality of discharge nozzles so that liquid may be pumped through the central manifold and out through the nozzles to roil the sediment or other foreign material at the bottom of the tank and suspend it for withdrawal through a side withdrawal pipe located above the apparatus.

Emond et al. U. S. Pat. No. 3,953,226 is directed to a device for cleaning sediment from a hot wort tank including pipe means oscillatably suspended from the top of the tank, the oscillatable pipe means being provided at a discharge point near the bottom of the tank with one or more spray jets through which hot water may be sprayed to sweep suspended matter to a sump located on the opposite side of the storage tank for removal.

Heibo U. S. Pat. No. 3,878,857 is directed to a device for cleaning the side walls of a storage tank such as a tank located on a ship carrying crude oil. The apparatus comprises an L-shaped inlet pipe suspended from the top of the tank, a pair of diametrically opposed jets are mounted on the end of the "L" so that liquid pumped through the L-shaped inlet pipe will be forced to flow out of the pipe through one of the jets at a time. Means are provided for rotating the jet nozzles about their vertical axis and an indexing means is also provided for rotating the jetting means a fraction of a turn about a horizontal axis for each complete revolution about the vertical axis. The mechanism for accomplishing this is suitably a worm gear which operates in conjunction with a cog wheel and a blocking wheel.

Richard et al. U. S. Pat. No. 2,116,935 is directed to a method and apparatus for cleaning tanks such as railroad tank cars and comprises a pipe which is suspended vertically in the tank for rotation about a horizontal axis and which contains at the lower end thereof a reaction nozzle mounted for rotation about a horizontal axis and includes a reaction nozzle member mounted on the vertical conduit for rotation about a horizontal axis so that liquid pumped down the conduit is forced out the vertically disposed jets of the reaction nozzle. The device also includes appropriate means for slowly rotating the reaction nozzle about the vertical axis of the suspending pipe.

BACKGROUND INFORMATION

It is a common commercial practice to store liquid materials in storage tanks. Typically, for many industrial applications, storage tanks will have a diameter from 100 to 300 feet and heights of 20 to 50 feet or more. The liquids stored in such storage tanks are diverse. For example, water or aqueous solutions of organic or inorganic chemicals may be stored in this manner, derivatives of agricultural products such as vegetable oils which are water soluble are likewise stored in this manner.

More commonly, however, large volume storage tanks of this nature are used in the production, collection and refining of crude oils and derivatives thereof such as crude oils containing naphthenic and aromatic components and refinery products such as gasolines, diesel fuels, jet fuels, fuel oils, kerosene, gas oil, etc., and petrochemical derivatives thereof such as benzene, xylenes, toluene, etc.

With the passage of time, solid materials, usually in finely divided form, will accumulate in the storage tank and settle at the bottom thereof. When the accumulation becomes excessive, it must be removed from the storage tank.

One manner in which this can be accomplished is to drain the tank and manually remove the sediments that are deposited therein. However, such a procedure is costly and time-consuming and can cause the workmen involved therein to be exposed to toxic or potentially toxic materials.

The problem of sediment accumulation is particularly accentuated insofar as the storage of crude oil and, in particular, aromatic and naphthenic crude oils is concerned. Such crude oils, as introduced into the storage tank, will normally contain aromatic, naphthenic and asphaltic components which are believed to be potentially reactive and/or condensible with each other. Moreover, a minor amount of water will normally be present in the crude oil (e.g., about 0.1 to 5 wt.%), but, usually, the water will not be present as a separate phase, but rather as small droplets of water emulsified by ionizable components of the crude oil, such as asphaltenes.

It is believed that molecular charge transfer forces, such as Van Der Waals forces, cause many of the molecular aromatic, naphthenic and asphaltic components of the crude oil to agglomerate and weakly bond to each other to form aggregates having a size sufficient to cause them to precipitate from the crude oil and to settle at the bottom of a crude oil storage tank together with the emulsified water droplets so that the resultant "hydrocarbon sludge" will normally comprise highly aromatic components such as polyaromatic components in which a significant portion of the water (in the form of emulsified droplets) will be occluded. Also, when prophyrins are present, the porphyrin molecules are believed to be intercallatively attracted to each other so as to form agglomerates that will settle from the crude oil stored in the crude oil storage tank. It is for reasons such as these that the sediment in the bottom of a crude oil storage tank is sometimes colloquially referred to as "black sediment and water" or "hydrocarbon sludge" or just plain "sludge".

The hydrocarbon sludge that accumulates, as such, is of marginal economic value and, if manually removed, usually represents a disposal problem.

It is known to remove sediments from a storage tank by agitating the liquid in the storage tank so as to resuspend the sediment so that a stream of sediment-containing liquid can be withdrawn from the storage tank and filtered, as illustrated, for example, by Furness et al. U. S. Pat. Nos. 4,407,678 and 4,685,974.

However, the prior art practices have not been entirely satisfactory and there is need for improvement.

SUMMARY OF THE INVENTION

The present invention is directed to a method and apparatus useful for the removal of sediment, such as hydrocarbon sludge from a storage tank containing a liquid such as crude oil.

The apparatus of the present invention, in one aspect thereof, comprises a liquid circulator for dispersing sediment at the bottom of a storage tank into a liquid in the storage tank, the liquid circulator comprising a hollow housing open at the rear end thereof for placement in the storage tank, liquid agitation means including a plurality of nozzled outlet jets laterally mounted on the housing in fluid communication with the interior thereof and connecting means comprising an independently rotatable tubular casing mounted on the open rear end of the hollow housing, the connecting means being provided with casing turning means mounted in the tubular casing and nozzle drive means carried by the tubular casing and operatively connected with the nozzled outlet jets of the liquid agitation means; the connecting means being coupled at the rear end thereof with multi-joint support pipe means comprising a plurality of joints of pipes sequentially coupled to each other, each joint of pipe having interconnective turning means rotatably mounted therein and coupled to the interconnective turning means of adjacent joints of pipes, the first joint of pipe being coupled at the front end thereof to the rear end of the tubular casing of the connecting means and the interconnective turning means of the first joint of pipe being operatively coupled to the casing turning means whereby liquid pump means can be fluidly interconnected with the multi-joint support pipe means adjacent the rear end thereof to supply fluid under pressure through the joints of pipe to the interior of the tubular casing, the housing and thence to the nozzled outlet jets of the agitation means and whereby indexing power means can be operatively connected with the interconnective turning means of the outermost joint of pipe for rotating the interconnective turning means of said joints of pipe and said tubular casing of said connecting means and hence, for rotating said nozzle drive means and said nozzled outlet jets operatively connected therewith at a predetermined rate independent of the pressure and rate of flow of liquid through the nozzled outlet jets.

In greater particularity, the apparatus of the present invention comprises a hydrocarbon circulator comprising an elongate sled, a hollow housing pivotally mounted adjacent the front end thereof on the sled adjacent the front end of the sled and comprising a lateral barrel segment closed at the front end and open at the rear end thereof and also having an upstanding tubular support segment, liquid agitation means comprising a tubular base rotatably mounted on the upstanding tubular support segment of the housing, the crude oil circulator also comprising connecting means composed of a tubular casing mounted at the front end thereof on the open end of the lateral barrel segment, the tubular casing being independently rotatable about its longitudinal axis and having a kelly mounted therein and also being provided with nozzle drive means carried by the tubular casing and operatively connected with the nozzled outlet jets of the liquid agitation means; the crude oil circulator being supported on a multi-joint support pipe means comprising a plurality of joints of pipe sequentially coupled to each other, each joint of pipe having a kelly rod rotatably mounted therein and coupled to the next adjacent kelly rod, the most forward of the joints of pipe being coupled to the rear end of the tubular casing and the kelly rod of the most forward of the joints of pipe being operatively coupled to the kelly.

High pressure crude oil pump means are also fluidly interconnected with the multi-joint support pipe means adjacent the rear end thereof for supplying crude oil under pressure through the joints of pipe to the interior of the tubular casing and thence to the nozzled outlet jets and indexing power means are operatively connected with the outermost of the kelly rods for rotating the kelly rods and the kelly and hence, for rotating the nozzled outlet jets at a predetermined rate independent of the rate of flow of liquid through the nozzled outlet jets; whereby hydrocarbon sludge suspended in the crude oil storage tank in which the crude oil circulator is placed will be resuspended in the crude oil by the crude oil circulator.

Preferably, the mass of the sled will be greater (i.e., more than half of the combined mass) of a combination of the sled, the hollow housing, the liquid agitation means and the connecting means whereby the center of gravity of the sled and the combination will be below the linear lateral axis of the hollow housing and the connecting means so that when the sled and the combination are suspended from the multi-joint pipe support means the sled will lie below the circulator.

In a further aspect of the apparatus of the present invention, a crude oil storage tank such as one having a diameter of about 100 to 300 feet and a height of about 20 to about 50 feet and having a manway in the side thereof is provided with apparatus useful for redispersing hydrocarbon sludge in the crude oil stored therein comprising a gate valve mounted on the outside of the storage tank over the manway, an elongate tubular isolation barrel laterally mounted on the gate valve, the isolation barrel being open at the front end thereof and closed at the rear end thereof and having a tubular packing gland mounted in the closed rear end and also being provided with a valved drain line at the side thereof; a crude oil circulator of the present invention of the type described above being insertable into the isolation barrel through the open end thereof and the multi-joint pipe support means being interconnected with the crude oil circulator through the packing gland at the rear end of the isolation barrel so that, when the gate valve is open, the multi-joint support pipe means may be pushed through the packing gland to thereby force the crude oil circulator into a desired location in the crude oil storage tank, such as a location adjacent the center thereof, so that crude oil may be supplied to the nozzled outlet jets in the manner described above and so that the nozzled outlet jets can be rotated by the indexing power means in the manner described above to thereby resuspend and redisperse the hydrocarbon sludge in the crude oil.

In a further aspect of the apparatus of the present invention, a crude oil storage tank of the type described above having a manway, an elongate isolation barrel and containing a crude oil circulator, as described above, also includes filter means located outside the crude oil storage tank, drain line conduit means fluidly interconnecting the drain line of the isolation barrel with the filter means, filter conduit means fluidly interconnecting the filter means with the suction side of a high pressure crude oil pump; the discharge side of the high pressure crude oil pump being fluidly interconnected with the multi-joint support pipe means whereby, on opening of the gate valve and insertion of the crude oil circulator into the crude oil storage tank and in operation of the high pressure crude oil pump, crude oil will be withdrawn from said storage tank through the isolation barrel, the drain line, the filter means and the drain line conduit means and the filter conduit means to the suction side of the high pressure pump and thence, after being pressured, to the multi-joint support pipe means for recycle to the storage tank through the multi-joint pipe support means, the connecting means, the housing and the nozzled outlet jets.

In yet another embodiment of the present invention, the apparatus of the present invention also includes a tripping rack adjacent the crude oil storage tank in laterial axial alignment with the isolation barrel, the tripping rack comprising an elongate frame, reciprocation means carried by the frame for movement backward and forward along the frame, a tripping sled carried by the reciprocating means, a pushpull coupling means comprising a push-pull sub mounted on the tripping sled so that a first joint of pipe interconnected with a crude oil circulator in the isolation barrel and extending through the packing gland can be interconnected with a next joint of pipe mounted on the tripping rack and connected to the push-pull sub so that forward motion of the push-pull sub will cause the next joint of pipe to be pushed through the packing gland and so that additional joints of pipe can be coupled to the second joint of pipe in the described manner and progressively pushed through the packing gland to thereby progressively push the crude oil circulator into the crude oil storage tank and to support it therein and to position it in a desired location such as a position adjacent the central part of the crude oil storage tank.

The Dispersion Method of the Present Invention

In its broader aspects, the method of the present invention for cleaning hydrocarbon sludge from a crude oil storage tank includes the steps of positioning a crude oil circulator of the present invention comprising a hollow housing having a plurality of nozzled outlet jets rotatably mounted thereon in a crude oil storage tank containing hydrocarbon sludge, continuously forcing crude oil through the nozzled outlet jets and mechanically laterally rotating the nozzled outlet jets about a vertical axis at a rate of about 0.5 to 5 rotations per hour to slowly suspend hydrocarbon sludge in the crude oil in the crude oil storage tank, continuously draining a portion of the crude oil having hydrocarbon sludge suspended therein from the crude oil storage tank, continuously filtering solids from the suspension, continuously pressuring the filtered crude oil and continuously reinjecting the pressured, filtered crude oil into the tank through the nozzled outlet jets.

One embodiment of the present invention is directed to a method for positioning in a crude oil storage tank a crude oil circulator of the present invention comprising a hollow housing on which a pair of opposed nozzled outlet jets are rotatably mounted and wherein the rotation of the nozzled outlet jets is controlled by indexing power means outside the tank operatively interconnected with the nozzled outlet jets through multi-joint support pipe means for supplying liquid under pressure to the housing and thence to the nozzled outlet jets.

In accordance with this embodiment, a crude oil circulator of the present invention comprising a housing open at the rear end thereof on which nozzled outlet jets are rotatably mounted is slidably mounted in an isolation barrel open at the front end thereof and closed at the rear end thereof and having a tubular packing gland mounted in the closed rear end thereof and the isolation barrel is then mounted on a gate valve covering a manway in the side of the crude oil storage tank. A plurality of joints of pipe are sequentially mounted on an elongate tripping rack positioned adjacent the rear of the isolation barrel in lateral alignment therewith and the joints of pipe are sequentially coupled to a first joint of pipe extending through the elongate packing gland of the isolation barrel and joined to the crude oil circulator in the isolation barrel at the open rear end of the housing of the crude oil circulator; each of the joints of pipe after being sequentially coupled to a preceeding joint of pipe being forced through the elongate packing gland into the isolation barrel. As a consequence, the crude oil circulator is progressively forced from the isolation barrel into the crude oil storage tank while suspended from the thus-formed multi-joint support pipe means until the crude oil circulator is positioned at a desired location in the crude oil storage tank. After the crude oil circulator is properly located, crude oil is ejected from the nozzled outlet jets into the hydrocarbon sludge in the crude oil while the nozzled outlet jets of the crude oil circulator are being rotated about their vertical axis, as noted above.

In a more specific embodiment, the method of the present invention is directed to a method for dispersing and redissolving a hydrocarbon sludge comprising polyaromatic hydrocarbons, such as asphaltic polyaromatic sludge deposited from crude oil stored in a crude oil storage tank which comprises ejecting crude oil through a pair of opposed nozzled outlet jets at an injection velocity of at least about 200 to about 300 feet per second, thereby not only resuspending the deposited aromatic sludge but also depolymerizing the aromatic components of polyaromatic sludge molecules whereby such depolymerized components of the hydrocarbon sludge are redissolved in the crude oil, continuously draining a stream of crude oil having polyaromatic sludge suspended therein from the crude oil storage tank, filtering said thus-drained stream of crude oil, repressuring said stream of filtered crude oil and reinjecting said filtered, repressured stream of crude oil into said storage tank through said nozzled outlet jets.

In accordance with a preferred embodiment of the present invention, the method of redispersing hydrocarbon sludge in a crude oil stored in a crude oil storage tank comprises the steps of mounting a closed gate valve on a manway at the side of the storage tank, mounting an isolation barrel of the type described above on the gate valve, the isolation barrel having a crude oil circulator slidably mounted therein and having a first joint of pipe connected to the rear end thereof and extending through the packing gland of the isolation barrel, the first joint of pipe having interconnective turning means therein connected with the casing turning means of the connecting means; opening the gate valve, then connecting additional joints of pipe to the connected first joint of pipe and pushing said additional joints of pipe through said packing gland while interconnecting the interconnective turning means of each of the joints of pipe to thereby progressively increase the length of the multi-joint support pipe means and progressively force the crude oil circulator into the storage tank until the circulator is at a desired position in the tank such as one adjacent the center thereof.

Next, the drain line is sequentially fluidly interconnected with the drain line conduit means, filter means, filter conduit means and the suction side of a high pressure crude oil pump. The discharge side of the crude oil high pressure pump is fluidly interconnected with the multi-joint pipe means and the interconnective turning means of the multi-joint pipe support means are interconnected with indexing power means whereby, on actuation of the high pressure crude oil pump, a stream of crude oil will be withdrawn from the crude oil storage tank through the isolation barrel, the drain line, the drain line conduit means, the filter means and the filter conduit means to the suction side of the high pressure crude oil pump and pressured therein and discharged to the multi-joint support pipe means for recycle therethrough and through the nozzled outlet jets back to the crude oil storage tank; the interconnective turning means being operatively connected with indexing power means so that the nozzled outlet jets can be rotated at the rate of about 0.5 to about 5 revolutions per hour while the crude oil is being ejected from the nozzled outlet jets at an outlet velocity within the range of about 200 to about 300 feet per second sufficient to provide a velocity of at least about 1.5 feet per second at the periphery of the storage tank; whereby continuation of the recycle of said crude oil through said nozzled outlet jets and continuation of the rotation of said nozzled outlet jets will result in substantially complete redispersion and resuspension of the crude oil sludge in said crude oil storage tank into the crude oil stored therein.

DETAILED DESCRIPTION OF THE INVENTION

In accordance with the present invention, a gate valve comprising, for example, a housing is provided with flanges whereby the gate valve may be bolted or otherwise secured over the manway in the storage tank in any suitable manner, a valve for closing the bore of the housing such as a plate valve slidably mounted in the housing so that it can be raised into the bonnet of the valve to an open position and lowered to a closed position and appropriate means such as a handle for raising and lowering the plate valve. Also in accordance with the present invention, an elongate tubular isolation barrel having a diameter essentially equivalent to a diameter of the manway and open at the front end thereof and closed at the rear end thereof is provided with a flange or other appropriate means on the open end thereof so that it can be bolted or otherwise appropriately secured to the gate valve. A tubular packing gland is appropriately mounted at the rear end of the isolation barrel in elongate axial alignment with the elongate axis of the barrel and a drain line, such as a flanged drain line is provided at the side thereof.

Also in accordance with the present invention, a crude oil circulator is provided which is proportioned so that it can be slidably inserted into the open end of the isolation barrel before the isolation barrel is mounted on the gate valve. The liquid (i.e., crude oil) circulator, will appropriately comprise an elongate sled to which a hollow housing open at the rear end thereof is pivotally mounted, the hollow housing comprising a lateral barrel segment and an upstanding tubular support segment. The circulator also comprises liquid agitation means comprising a tubular base rotatably mounted on the upstanding tubular support segment of the housing, a transition pipe laterally mounted on the tubular base, a plurality of nozzled outlet jets, such as a pair of opposed nozzled outlet jets mounted on opposite ends of the transition pipe and nozzle turning means such as, for example, either a bevelled indexing gear mounted on the rotatable tubular base or a turning rod mounted to the inside of the transition pipe and extending downwardly therefrom into the opening in the housing.

The circulator of the present invention also comprises appropriate connecting means mounted on the open rear end of the tubular housing, the connecting means appropriately comprising an elongate tubular casing mounted on support bearings, the forward support bearing being rotatably mounted on the open end of the hollow housing. The rear support bearing of the elongate tubular casing is rotatably mounted on a tubing sub. The tubular casing is also provided with appropriate casing turning means such as a kelly of rectangular cross-section mounted in a kelly spider which is in turn mounted inside the tubular casing. Nozzle drive means are also mounted on the tubular casing for operative engagement with the nozzle turning means of the agitating means such as, for example, either a bevelled drive gear mounted on the forward support bearing in operative engagement with the bevelled indexing gear of the nozzle turning means or a differential linking pin interconnecting the turning rod of the nozzle turning means with the kelly of the connecting means.

In accordance with the present invention a circulator, such as a crude oil circulator, of the type described is mounted on a multi-joint support pipe means comprising a plurality of sequentially interconnected joints of pipe, each joint of pipe having an interconnective turning means mounted therein such as, for example, a circular kelly rod rotatably mounted in one or more vaned circular kelly rod spiders mounted inside each joint of pipe. Each of the joints of pipe is appropriately provided with connecting means such as a bevelled male thread at one end thereof and an internally bevelled female thread at the other end thereof, the threadings being flush with the body of the joint of pipe so that the connected joints of pipe have a uniform outer diameter throughout their entire length. In accordance with this construction, a first joint of pipe is connected with the tubing sub of the connecting means of a liquid circulator slidably mounted in the the isolation barrel at a location such that the axially aligned connecting means will align with the packing gland of the isolation barrel so that the rear portion of the first joint of pipe will extend outwardly from the isolation barrel through the packing gland.

In accordance with the present invention, a tripping rack is suitably utilized in order to "make up" the plurality of joints of pipe comprising the multi-joint pipe means. The tripping rack may appropriately comprise an elongate frame having an elongate central slot which is mounted on a suitable support means adjacent the rear end of the isolation barrel with the elongate slot in axial alignment with the isolation barrel. Suitable reciprocation means such as an endless chain is mounted in the elongate slot of the tripping frame, the endless chain being appropriately mounted for example, by means of an idler pulley at the front of the elongate slot and a cogged drive pulley at the rear of the elongate slot, the cogged drive pulley being interconnected with appropriate tripping rack power means such as a reversible hydraulic motor so that the endless chain can be moved in a forward direction or a rearward direction, as desired. A tripping sled is mounted on the reciprocation means for movement therewith and a push-pull coupling means such as a push-pull sub comprising a pivot rod and a pushpull pipe segment is mounted on the tripping sled. In accordance with the preferred embodiment of the present invention, the tripping rack is also provided with a transition sub and a gear box and an indexing power means, to be hereinafter described in greater detail.

With this arrangement, and with the first joint of pipe in place and connected to the tubing sub and with the kelly rod of the first joint of pipe connected to the kelly of the connecting means, the tripping sled will be moved to the rear of the tripping rack and a next joint of pipe mounted thereon and also to the push-pull pipe segment of the pushpull coupling means. The kelly rod of the second joint of pipe is connected with the kelly rod of the first joint of pipe by appropriate coupling means such as a keyed connecting means mountable in keyways on each end of the kelly rod so that the kelly rods are always in alignment with each other. After the kelly rods have been interconnected by the coupling keys and after the next joint of pipe has been appropriately coupled to the push-pull sub of the tripping rack and the first joint of pipe, the tripping rack power means is energized to move the tripping sled to the front of the tripping rack to thereby force the front of the second joint of pipe through the packing gland into the isolation barrel and, assuming that the gate valve is open, to thereby begin to force the crude oil circulator into the storage tank. The tubing sub is then uncoupled from the second joint of pipe and the tripping rack power means is energized to move the tripping sled to the rear of the tripping rack. Thereafter, the operation is repeated with additional joints of pipe in order to progressively force the crude oil circulator into the storage tank where it will be supported on the multi-joint support pipe means either continuously or until such time as, due to bending of the plurality of joints of pipe or deliberate sloping of the isolation barrel, the crude oil circulator impinges upon the bottom of the storage tank. The addition of joints of pipe normally is continued until the crude oil circulator is at about the center of the pipe.

When the crude oil circulator is appropriately positioned in the storage tank, the push-pull sub is disconnected from the rearmost of the joints of pipe and a transition sub is connected with the rearmost joint, the transition sub comprising an elbow-jointed elongate tubular casing open at the front end thereof for mating engagement with said rearmost joint of pipe and closed at the rear end thereof with a high pressure pipe packing gland. The transition sub also comprises a connecting rod rotatably mounted in the high pressure packing gland and appropriately connected, for example by means of a keyed coupling means, with the kelly rod of the rearmost joint of pipe at the front end thereof. The other end of the connecting rod is connected with a drive gear of a gear box mounted on the tripping rack which, in turn, is directly or indirectly operatively interconnected with a driven reduction gear operatively connected with a suitable indexing power means such as a hydraulic motor. Conventional hydraulic motors operate at a turning ratio of about 60 revolutions per minute, and by providing a gear box with a plurality of operatively interconnected gears having a gear reduction ratio of 3,600 to 1, it is possible to provide for rotation of the turning rod at about 1 revolution per hour by the indexing power means.

A high pressure pump such as a pump capable of delivering up to about 5,000 gallons per minute of liquid at a pressure of up to about 5,000 pounds per square inch is provided adjacent the crude oil storage tank and appropriate filter means such as a pair of filters mounted in parallel in filter tanks are also provided adjacent the storage tank. The filter means is fluidly interconnected with the drain pipe of the isolation barrel by appropriate drain line conduit means such as a hose, and a discharge end of the filter means is interconnected with the suction side of the high pressure pump by appropriate filter conduit means such as a hose. The discharge side of the high pressure pump is connected with the elbow joint of the transition sub by appropriate fluid conduit means such as a pipe capable of withstanding the pressure delivered by the high pressure pump.

Thereafter, assuming that the gate valve is open so that the isolation barrel is in fluid communication with the storage tank through the gate valve and filled with crude oil, the indexing power means will be energized to rotate the turning rod and, hence, the kelly rods and the kelly of the connecting means to thereby rotate the nozzle drive means mounted on the connecting means and, hence, the nozzle turning means of the liquid agitation means which, in turn, will rotate the nozzled outlet jets at a desired rate, such as a rate of about 0.5 to 5 revolutions per hour.

Simultaneously, the high pressure pump will be energized to cause a fluid such as crude oil to be withdrawn from the storage tank into the isolation barrel and then, through the drain line and drain line conduit means to the filter means where solids will be removed and then through the filter conduit means to the high pressure pump where the crude oil is appropriately pressured, for example, to a pressure of about 3,000 to about 5,000 psig. sufficient to deliver from about 10,000 to 20,000 gallons per minute of crude oil through the nozzles of the nozzled outlet jets at an initial nozzel velocity of about 200 to about 300 feet per second such that the velocity of the crude oil ejected through the nozzles of the nozzled outlet jets will have a velocity of about 1.5 to 2 feet per second adjacent the periphery of the crude oil storage tank.

With this construction and under these conditions, the crude oil ejected from the nozzled outlet jets will be ejected in the form of an expanding cone of turbulent ejected crude oil which, because of its high velocity, on impact with hydrocarbon sludge in the storage tank will cause the sludge to be progressively broken into smaller particles both physically and due to disruption of the molecular charge transfer forces interconnecting the asphaltic, naphthenic, polyaromatic, etc., molecular components of the sludge. As a consequence, the sludge will be progressively dispersed in the crude oil and will be of a size such that it will normally pass through the filters of the filter means so that at the end of the dispersing operation, the aromatic, asphaltic, naphthenic and/or porphrynic components of the sludge will have been molecularly redispersed in the crude oil so that they will comprise a part of the crude oil that is withdrawn from the storage tank for processing in the refinery within which the crude oil storage tank is located.

DETAILED DESCRIPTION

Figure 1:
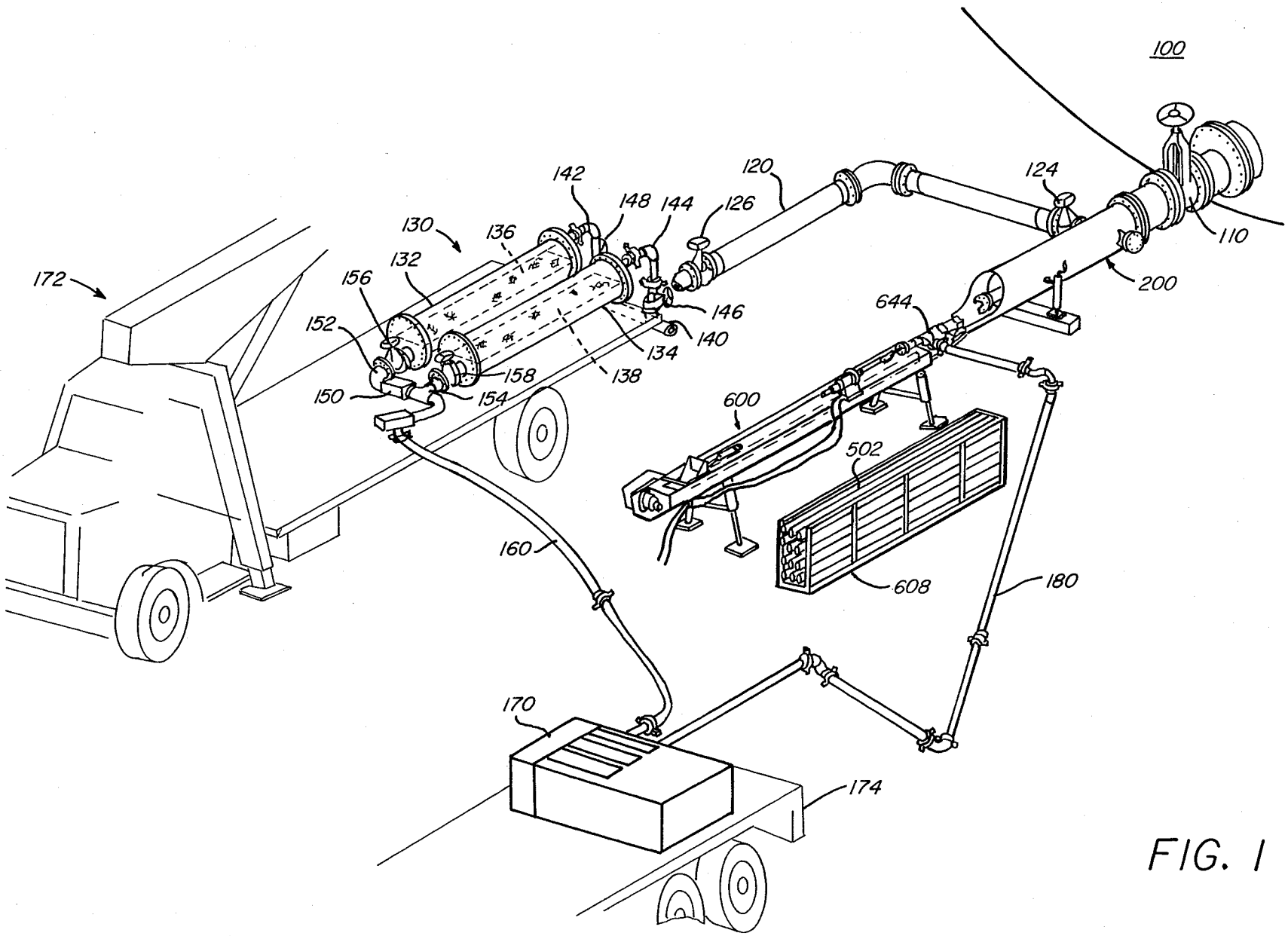
FIG. 1 is a schematic view, with parts broken away, illustrating, in general, the manner in which the apparatus of the present invention may be assembled so as to practice the process of the present invention.
Figure 2:
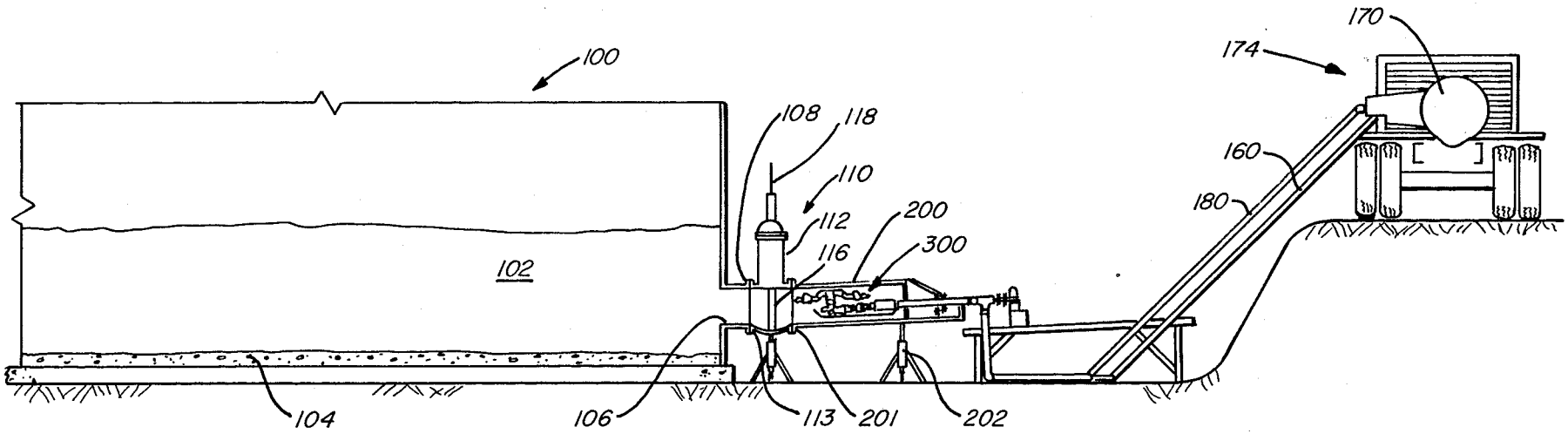
FIG. 2 is a sectional view showing a storage tank to which a gate valve, an isolation barrel of the present invention, a liquid circulator of the present invention and a high pressure pump have been connected, the liquid circulator being positioned inside the isolation barrel.

Turning now to FIG. 1, there is shown a portion of a storage tank 100 provided with a manway 106 (FIG. 2) to which a gate valve 110 has been mounted in any suitable manner and to which an isolation barrel 200 has been secured, in turn, in any suitable manner (e.g., as shown in FIG. 2, through the provision of manway flange 108 on the manway 106, gate valve flanges 113 on the bore 112 of the gate valve 110 and an isolation barrel flange 201 on the isolation barrel 200; the flanges 108, 113 and 201 being interconnected in any suitable manner, such as through the provision of interconnecting nuts and bolts and seals, (not shown.) Drain line conduit means such as a drain pipe 120 provided with a drain pipe inlet valve 124 and a drain pipe outlet vavle 126 is fixed to the drain line 214 on the side of the isolation barrel 200 in any suitable manner. Filter means 130 are fluidly interconnected with the drain pipe 120 through drain pipe outlet valve 126 in any desired manner (e.g., through the provision of mating flanges (not shown) which are bolted together.

The filter means 130 may be of any desired construction known to those skilled in the art and may comprise, for example, a pair of filter casings 132 and 134 in which a pair of filters 136 and 138 are mounted; each of the filters 132–134 being interconnected with a filter inlet manifold 140 by filter inlet lines 142 and 144 controlled by filter inlet valves 146 and 148 in the inlet lines and being interconnected with a filter outlet manifold 150 by filter outlet lines 152 and 154 controlled by filter outlet line valves 156 and 158, respectively.

The filter outlet manifold 150 is fluidly interconnected by any suitable means such as a filter conduit hose 160 with the suction side of a high pressure pump 170. Normally, the filter means 130 will be mounted on a truck 172 for convenience of transportation and likewise, the high pressure pump 170 wil be mounted on a truck 174 for ease of transportation.

The discharge side of the high pressure pump 170 is fluidly interconnected with an elbow joint 644 by any suitable means such as a pump discharge pipe 180.

Figure 10:
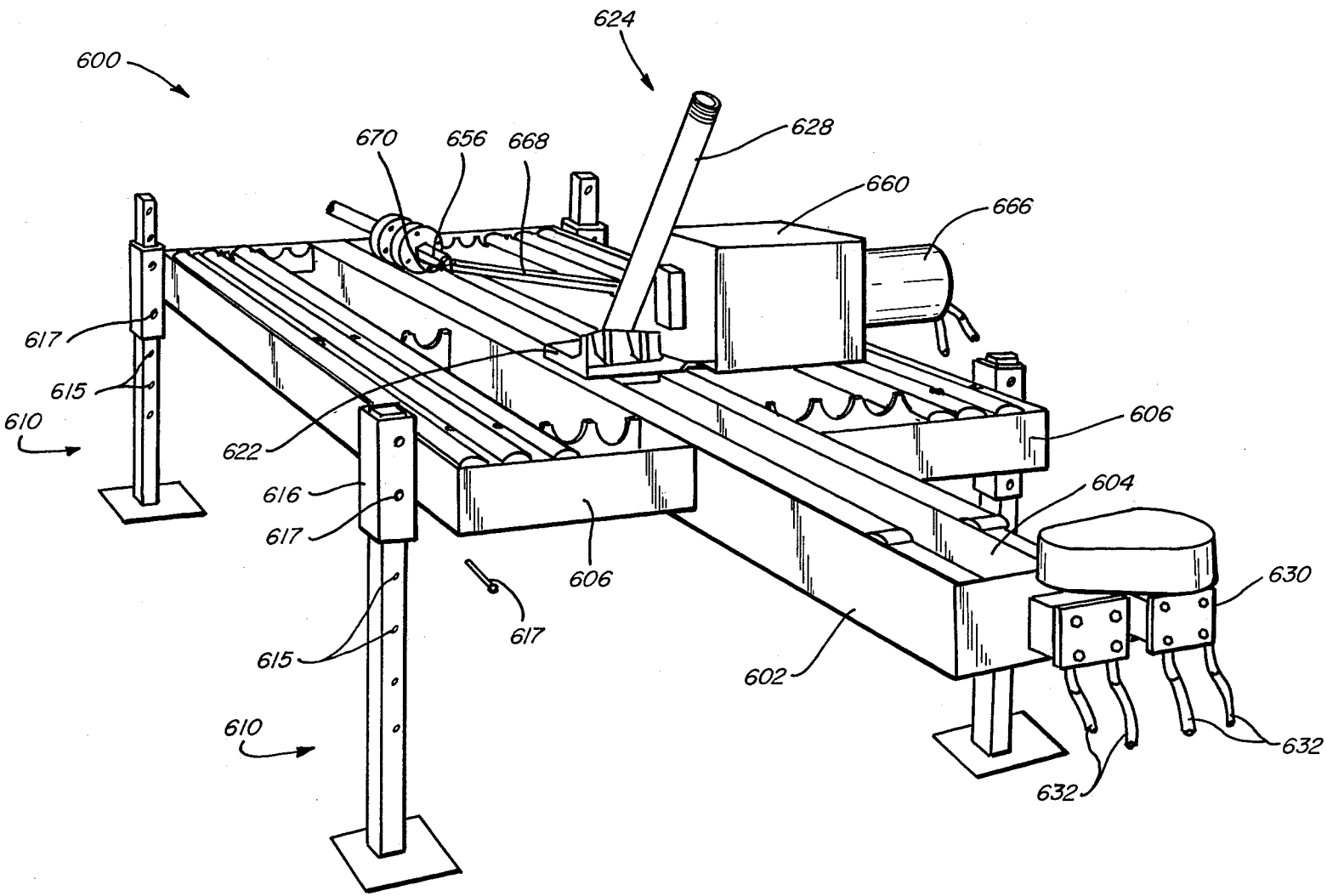
FIG. 10 is a perspective view of a tripping rack useful in the practice of the present invention.

A tripping rack 600 mounted adjacent the end of and in axial alignment with the isolation barrel 200 is used for assembling the multi-joint support pipe means of the present invention; the construction of a preferred embodiment of the tripping rack being shown in more detail in FIG. 10.

Figure 3:
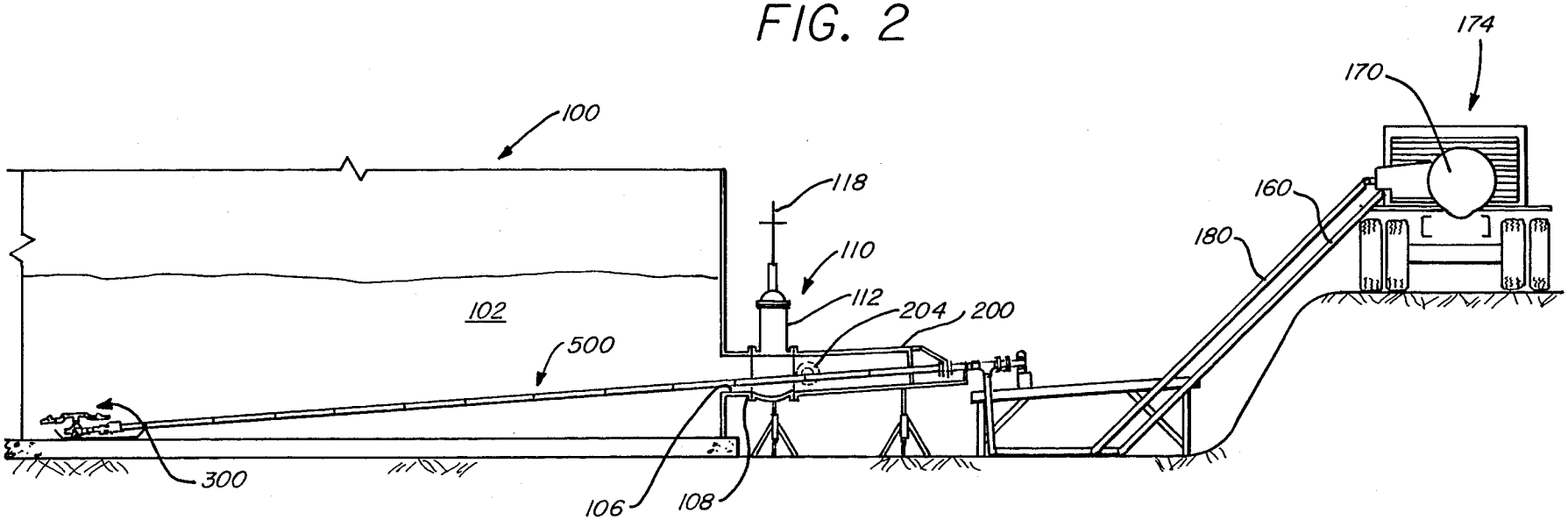
FIG. 3 is a sectional view similar to FIG. 2 showing the liquid circulator in position in the storage tank.

Turning now to FIGS. 2 and 3, there is shown a storage tank 100, such as a crude oil storage tank containing crude oil 102 and, as shown in FIG. 2, hydrocarbon sludge 104. The crude oil storage tank 100 is provided with a manway 106 such as a manway having a manway flange 108 on which a gate valve 110 is mounted in the manner described above. The gate valve 110 may be of any desired construction and may comprise, for example, a bonnet 112 and a base provided with flanges 113 into which a valve plate 116 may be raised and lowered by appropriate turning means such as a turning bar 118.

Figure 9:
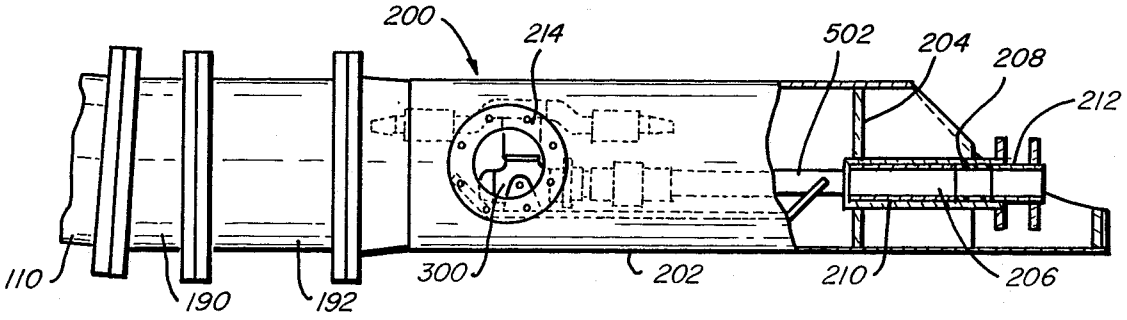
FIG. 9 is a side view, partially in section, of an isolation barrel constructed in accordance with the present invention.

A flanged isolation barrel 200, the details of construction of which are shown more clearly in FIG. 9, is appropriately mounted on the gate valve 110 and held in place by suitable means such as supports 202.

Figure 6:
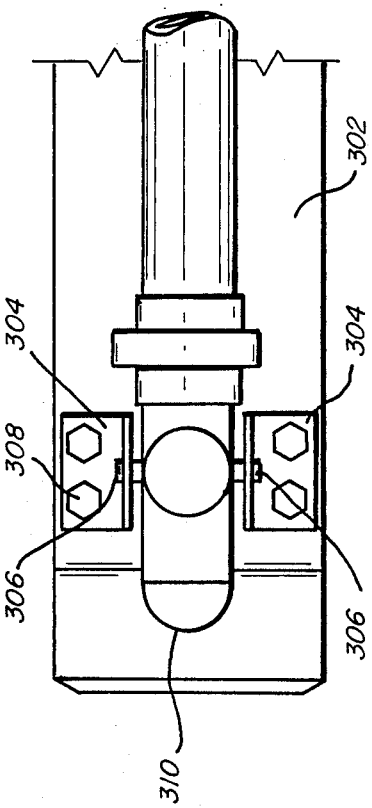
FIG. 6 is a top view showing the manner in which the circulator of FIG. 5 is mounted on a sled.

A crude oil circulator designated generally by the 15 number 300 is positioned in the isolation barrel 200 before the isolation barrel 200 is bolted to the flanges 113 of the gate valve 110 by nuts and bolts (not shown). The details of construction of appropriate crude oil circulators 300 are shown in FIGS. 4, 5 and 6.

Figure 7:
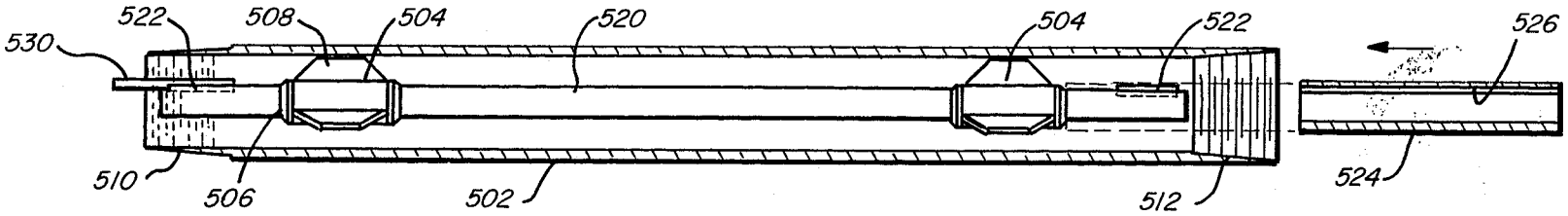
FIG. 7 is a sectional view of a joint of pipe having a kelly rod spider and a kelly rod mounted therein and showing the manner in which kelly rods are interconnected to the kelly rod coupling means with keys.

The crude oil circulator 300 may be appropriately inserted and positioned and supported in the crude oil tank 100 by a multi-joint pipe support means 500 the details of which are shown in more detail in FIG. 7.

Figure 4:
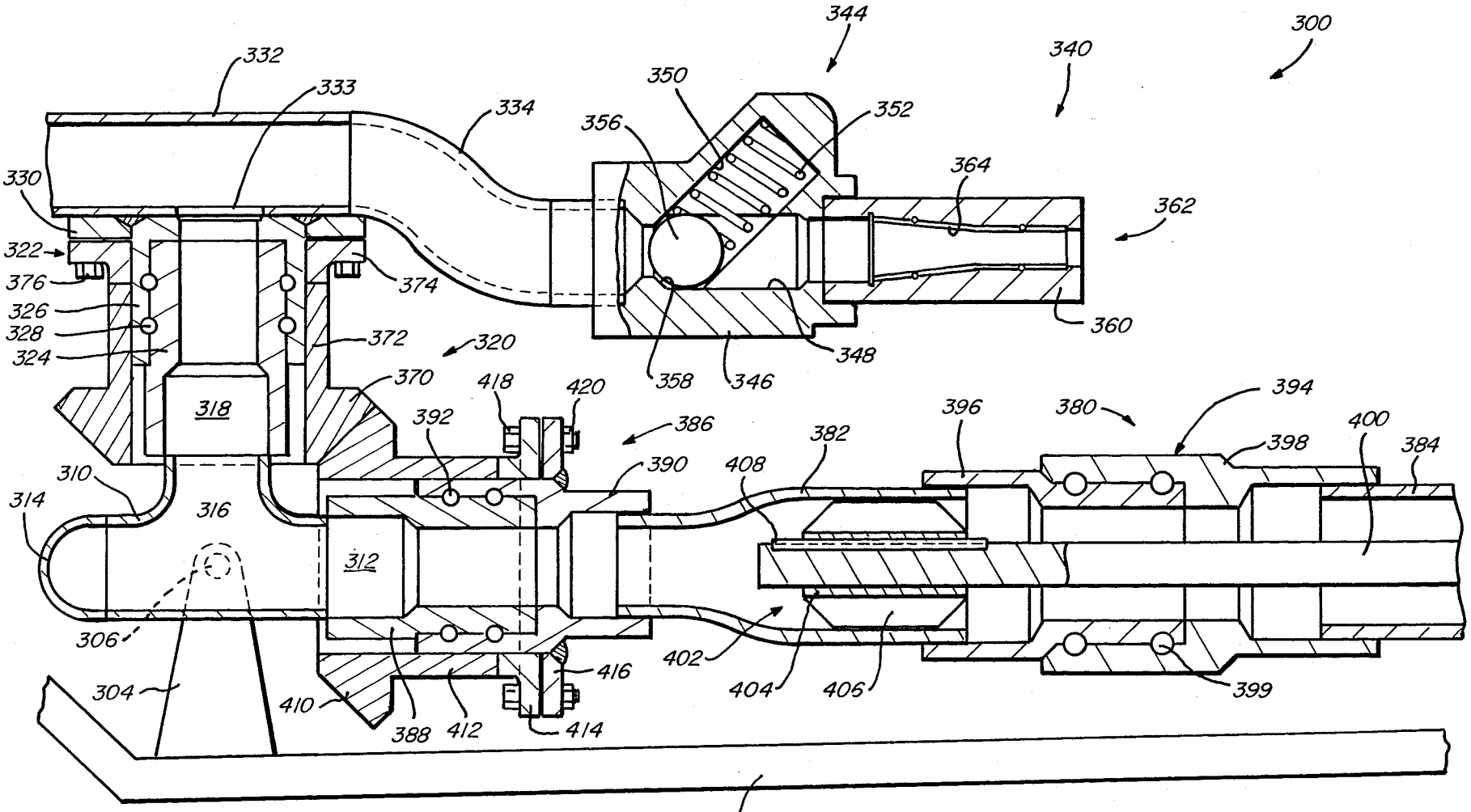
FIG. 4 is a sectional view illustrating a preferred embodiment of the liquid circulator of the present invention.
Figure 5:
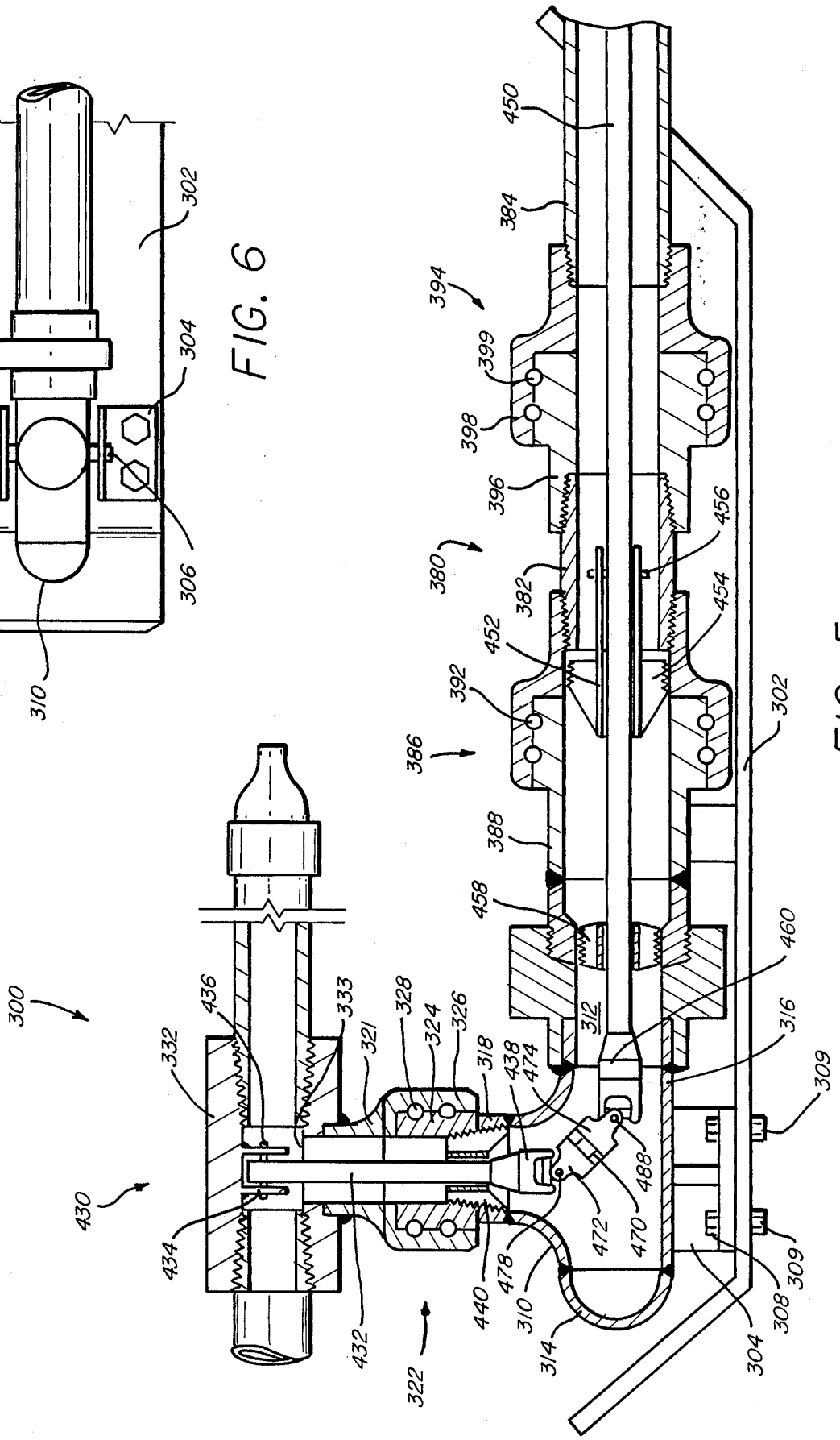
FIG. 5 is a sectional view showing another embodiment of a liquid circulator that may be used in accordance with the present invention.

Turning now to FIG. 4, there is shown a preferred embodiment of a liquid circulator such as a crude oil circulator 300. The crude oil circulator 300 comprises a sled 302 provided with a bracket 304 adjacent the front end thereof on which is pivotally mounted by any appropriate means such as pivot pins 306, a hollow housing 310 having an opening 312 at the rear end thereof and being closed by a surge cap 314 at the front end thereof. The hollow housing 310 also comprises a lateral barrel segment 316 provided with an upstanding tubular support segment 318 in fluid communication with the interior of the hollow housing 310.

Liquid agitation means of any suitable construction are rotatably mounted on the upstanding tubular segment 318 of the hollow housing 310. For example, the liquid agitation means may comprise a tubular base on which is mounted a rotatable support bearing such as a chicksan bearing comprising a fixed inner support ring 324, a rotatable outer support ring 326 and interconnecting ball bearings 328. A connecting pipe flange 330 is fixed to the outer rotatable ring 326 of the rotatable bearing and a transition pipe 332 is fixed to the connecting pipe flange 330 in any suitable manner such as, for example, by welding.

In the preferred embodiment of the present invention, a pair of nozzled outlet jets designated generally by the number 340, only one of which is shown, are mounted on opposite ends of the transition pipe 332 so that the nozzled outlet jets 340 are diametrically opposite to each other. Each of the jets 340 may be comprised, for example, of an extension pipe 334 used to adjust the vertical height and/or angularity of the nozzled outlet jet 340 and reverse flow control means such as a check valve 344 is mounted on the outer end of the extension pipe 334. The reverse flow control means (check valve 344) may comprise, for example, a check valve housing 346 having a bore 348 therein, the check valve housing 346 being mounted on the extension pipe 334 at the outer end thereof with the check valve bore 348 in communication with the interior of the extension pipe 334. The check valve housing 346 is provided with an angled offset core 350 in which a check valve spring 352 is mounted under tension so as to urge a check ball 356 into engagement with a check valve seat 358 in the check valve bore 348. With this construction, the check ball 356 will normally be urged into a closed seating position against the check ball seat 358 so that fluid cannot flow into the interior of the extension pipe 334. A nozzle 360 having orifice 362 formed therein and lined with an appropriate errosion resistant material such as a tungsten carbide liner 364 is mounted on the discharge end of the check valve housing 346.

It is also to be observed that the transition pipe 332 is provided with a side port 333 in order to establish fluid communication with the interior of the upstanding tubular support segment 318 of the hollow housing 312 and the interior of the tubular base 321.

Nozzle drive means are carried by the transition pipe 332 for rotating the nozzled outlet jets 340. In the embodiment shown in FIG. 4, the nozzle turning means comprises a flanged bevelled indexing gear 370 mounted to the transition pipe 332 in any appropriate manner, such as, for example, through the provision of a tubular indexing gear shaft 372 sized to fit around the rotatable outer ring 326 of the rotatable bearing, the bevelled indexing gear 370 also being provided with an indexing gear flange 322 fixed to the tubular indexing gear shaft 372 at the outer end thereof. With this construction, the tubular indexing gear flange 322 can be mounted on the connecting pipe flange 330 in any suitable manner, such as by means of a plurality of transition pipe collar bolts 376 and fixed with tightening nuts (not shown).

In accordance with the preferred embodiment, a connecting means designated generally by the number 380 and comprising an independently rotatable tubular casing 382 is provided which is fixed to the opening 312 of the housing 310 in any appropriate manner so as to be rotatable thereabout. For example, a forward rotatable support bearing such as chicksan bearing 386 comprising a fixed inner forward bearing ring 388 may be mounted on the tubular housing 310 about the opening 312 to establish fluid communication between the opening 312 and the interior of the tubular casing 382. A rotatable outer forward bearing ring 390 is fixed to the forward end of the tubular casing 382 to complete the forward rotatable support bearing 386. Rotatability is provided through the provision of ball bearings 392.

In accordance with this construction, a tubing sub 384 is provided and a rear rotatable support bearing such as a chicksan bearing designated generally by the number 394 is used to interconnect the tubing sub 384 with the rotatable tubular casing 382. In accordance with this construction, a rotatable inner rear bearing ring 396 is fixed to the back end of the tubular casing 382 and a fixed outer rear bearing ring 398 is mounted on the tubing sub 384. Rotatability is provided through the provision of ball bearings 399.

The connecting means 380 is also provided with appropriate casing turning means such as, for example, a kelly 400 comprising an elongate metal bar of rectangular (i.e., square) cross-section which is mounted on a kelly spider designated generally by the number 402 and comprising a kelly support bracket 404 of mating rectangular cross-section in respect of the kelly 400 which is fixed in the tubular casing 382 by kelly support vanes 406 which are threaded or welded or in other appropriate manner connected to both the kelly support bracket 404 and the interior of the tubular casing 382. The kelly 400 is fixed to the kelly support tube 404 in a desired predetermined location by means of a kelly key 408 which mounts in mating key slots in the kelly 400 and the kelly support tube 404.

The connecting means 380 is also provided with appropriate nozzle drive means which, in the embodiment shown in FIG. 4, comprises a flanged tubular bevelled drive gear 410 provided with a tubular drive gear shaft 412 and a tubular drive gear flange 414 which are sized to fit about the rotatable outer forward bearing ring 390. The rotatable outer bearing ring 390 is also provided with an outer forward bearing pipe collar 416 so that the tubular drive gear flange 414 can be fixed to the collar 416 by any appropriate means such as bolts 418 and tightening nuts 420.

With this construction the tubular casing 382, which is freely rotatable about ball bearings 392 and 399 supports the hollow housing 310 of the crude oil circulator 300, the housing 310 also being free to rotate about the tubular casing 382 through the provision of ball bearings 392. It is necessary that the liquid circulator 300 be in an upright position inside a storage tank 100 if it is to work effectively. Therefore, in accordance with the present invention, a sled 302 is provided having a weight (mass) greater than the combined weight of the hollow housing 310, the liquid agitating means 320 and the connecting means 380. As a consequence, the center of gravity for the combination of the sled 302 with the housing 310, the agitating means 320 and the connecting means 380 will be below the aligned lateral axes of the tubular housing 310 and the tubular casing 382. As a consequence, the sled 302, by virtue of its weight, will alwaYs be below the aligned lateral axes of the hollow housing 310 and the tubular casing 382 so that the crude oil circulator 300 will be in an upright position.

Turning now to FIG. 5, a modified liquid circulator 300 of the present invention is shown. The liquid circulator 300 of FIG. 5 is similar to the liquid circulator 300 of FIG. 4 in that there is provided a sled 302 upon which a hollow housing 310 is pivotally mounted about a bracket 304, the hollow housing 310 being provided with an opening 312 at the rear end thereof, a surge cap 314 and a lateral barrel segment comprising an upstanding tubular support segment 318. Agitating means 430 of a construction to be described is rotatably mounted on the upstanding tubular support segment 318 by any suitable means such as through the provision of a rotatable bearing such as a chicksan bearing 322 comprising a fixed inner ring 324 fixed to the upstanding tubular support segment 318 and a rotatable outer ring 326 rotatably interconnected with the inner ring 324 by means of ball bearings 328. Connecting means 380 comprising a tubular casing 382 and a tubing sub 384 are also provided, the tubular casing 382 being rotatably mounted to the lateral barrel segment 316 through the provision of a forward rotatable support bearing assembly 386 of any appropriate construction, such as a chicksan bearing, comprising a fixed inner forward bearing ring 388, which is mounted on the housing 310 about the opening 312 and a rotatable outer forward bearing ring which is mounted on the tubular casing 382 and rotatably interconnected with the fixed inner forward bearing 388 by ball bearings 392. In like manner, the tubular casing 382 is rotatably mounted on the tubing sub 384 by any appropriate means such as a rear rotatable bearing such as a chicksan bearing 394 comprising, for example a rotatable inner rear bearing ring 396 mounted on the tubular casing 382 and a fixed outer rear bearing ring 396 mounted on the tubing sub 384 and interconnected with the inner bearing ring 396 by ball bearings 392.

However, in the embodiment of liquid circulator 300 shown in FIG. 5, the liquid agitation means 320 also comprises an agitator turning rod 432 which is vertically mounted in the bore of the upstanding tubular support segment 318 and fixed to the transition pipe 332 opposite the side port 333 therein by any appropriate means such as an upper agitator turning rod bracket 434 fixed to the transition pipe 332 and interconnected with the agitator turning rod 432 by means of an upper turning rod connecting pin 436. The agitator turning rod 432 is also provided at the lower end thereof with a lower agitator turning rod bracket 438. In order to ensure that the agitator turning rod 432 is centered in the bore of the upstanding tubular support segment 318, the upstanding tubular support segment 318 is provided with an agitator turning rod spider 440 which is connected thereto in any appropriate manner such as by means of connecting threads.

In accordance with the embodiment of the present invention shown in FIG. 5, there is also provided a tubular casing 382 which is rotatably connected to the lateral barrel segment 316 of the housing 310 by any suitable means such as a rotatable bearing comprising, as in FIG. 3, a forward rotatable bearing support ring fixed about the open end of the housing 310, a rotatable outer forward bearing ring fixed to the tubular casing 382 in any suitable means such as by appropriate threads and interconnected with the fixed inner forward bearing ring by means of ball bearings 392. In like fashion, the tubing sub 384 is mounted to the rear end of the tubular casing 382 by an appropriate rotating bearing comprising, for example, rotatable inner rear bearing ring 394 fixed to the tubular casing 382, fixed outer rear bearing ring 398 fixed to the tubing sub 384 and interconnected with the rotatable inner bearing pipe 396 by ball bearings 399.

With this construction, however, the kelly that is provided is an elongate kelly which extends beyond the tubular casing 382 and through the opening 312 of the housing 310 into the interior thereof. Also, a modified kelly support spider 452 is provided which, in this situation may be of a circular cross-section and of greater dimensions than the maximum dimension of the kelly rod. The modified elongate kelly is connected to the modified kelly spider support 452 by means of a kelly spider pin 456. With this construction there is also provided a forward kelly support spider 458 adjacent the opening 312 in the housing 310 in which the kelly 450 is rotatably mounted and the kelly 450 is also provided with a forward kelly bracket 460.

In accordance with this construction, the elongate kelly is interconnected with the turning rod 432 by means of a differential link 470 comprising a forward linking pin bracket 472 and a rear linking pin bracket 474; the differential link 470 being interconnected with the turning rod 432 through the forward linking pin bracket 472 and the lower turning rod bracket 438 by means of a forward link pin 478. The differential link pin 470 is interconnected with the elongate kelly 450 by means of the forward kelly bracket 460 and the rear link pin bracket 474 by means of a rear link pin 488.

Turning next to FIG. 6, the manner in which the hollow housing 310 is pivotally mounted on the sled 302 is shown more clearly. Thus, as is shown in FIG. 6, the bracket 304 is provided with pinions 306 which pivotally connect the brackets 304 with the housing 310 and the brackets 304 are fixed to the sled 302 by means of bolts 308 and secured in place through the provision of securing nuts 309 (see FIG. 5).

Turning now to FIG. 7, there is shown one of the joints of pipe utilized in preparing the multi-joint support pipe means of the present invention. The joint of pipe 502 has kelly rod spiders 504 mounted adjacent each end thereof, each of the kelly rod spiders 504 comprising a tubular kelly rod holder 506 in which a kelly rod 520 can be rotatably mounted and a plurality of kelly rod spider support vanes 508 fixed to the outer wall of the tubular kelly rod holder 506 and the inner wall of the joint of pipe 502 by any suitable means such as welding. A kelly rod keyway 522 is formed in each end of the kelly rod 520.

Appropriate means are provided for interconnecting the joints of pipe 502 with each other such as, for example, a male flush joint pipe thread 510 at one end (e.g., the front end) of a joint of pipe 502 and a female flush joint pipe thread 512 at the other end thereof.

Appropriate means are provided for interconnecting the adjacent kelly rods such as, for example, a kelly rod coupling pipe 524 provided with kelly rod coupling keyways 526 at each end thereof. With this construction, a kelly rod coupling key 530 can be inserted in each of the keyways 522 of the kelly rod 520 and interconnected with the keyways 526 on the inner bore of the kelly rod coupling pipe. Thus, by forming the keyway 522 in the kelly rod on the outer surface thereof and by providing a kelly rod coupling pipe 524 of a diameter such that it will fit over the kelly rod 520 and by then providing an inner surface keyway 526 therein, it is possible to easily assemble adjacent kelly rods. Also, it is to be observed that the keyways in the kelly rods 520 and the kelly rod coupling pipe 524 can be aligned with each other so that, for example, by always interconnecting the kelly rods 520 with the kelly rod coupling pipes 524 while the keyways are at the top of the respective units, it is possible to obtain an alignment of the kelly rods with the crude oil circulator 300.

Turning now to FIG. 10, there is shown a tripping rack 600 to be used in accordance with the present invention in preparing the multi-joint support pipe means. The tripping rack 600 may suitably comprise a tripping rack frame 602 provided with an elongate central slot 604 in which is mounted a drive gear (not shown) adjacent the rear end thereof and an idler gear (not shown) adjacent the front end of the elongate central slot 604. Suitable reciprocating means such as an endless chain (not shown) are used to interconnect the drive gear with the idler gear and the idler gear is operatively connected with appropriately tripping rack power means such as a hydraulic motor 630 through which hydraulic fluid can be circulated by means of hydraulic fluid lines 632.

Suitable pipe rack means for holding a plurality of joints of pipe 502 are also provided which, as shown in FIG. 11 may, if desired, comprise a pair of horizontal pipe racks 606 which are bolted or otherwise suitably secured to the elongate tripping rack frame 602 by any suitable means (not shown). Alternately, as shown in FIG. 1, the pipe rack means may comprise a separate pipe rack 608 which is positioned adjacent the tripping rack 600 and which is used to hold a plurality of joints of pipe 502. Suitable adjustable tripping rack support means are provided such as, for example, with reference to FIG. 10, adjustable tripping rack support means 610 comprising a base plate 612 on which an upstanding column 614 is mounted. An adjustable collar 616 is slidably mounted on each of the upstanding columns 614 and appropriate means are provided for adjusting the height of the tripping rack, such as a plurality of holes 615 in the upstanding column 614 in which adjusting pins 617 may be inserted through a corresponding hole 619 in the collar 616.

In accordance with this construction, a tripping sled 622 is slidably mounted on the tripping rack frame 602 and operatively interconnected with an endless chain for movement backward and forward along the tripping rack frame 602 in response to movement of the endless chain. A push-pull sub 624 comprising a push-pull pipe segment 628 and a pivot rod 624 are mounted on the tripping sled 622; the pivot rod being pivotally mounted on the sled 622 and extending into the push-pull pipe segment 628 and the push-pull pipe segment 628 being rotatably mounted on the push-pull pivot rod 626.

The tripping sled and the tripping rack are used to interconnect joints of pipe 502 in a manner to be described in order to provide the multi-joint support pipe means of the present invention.

Figure 8:
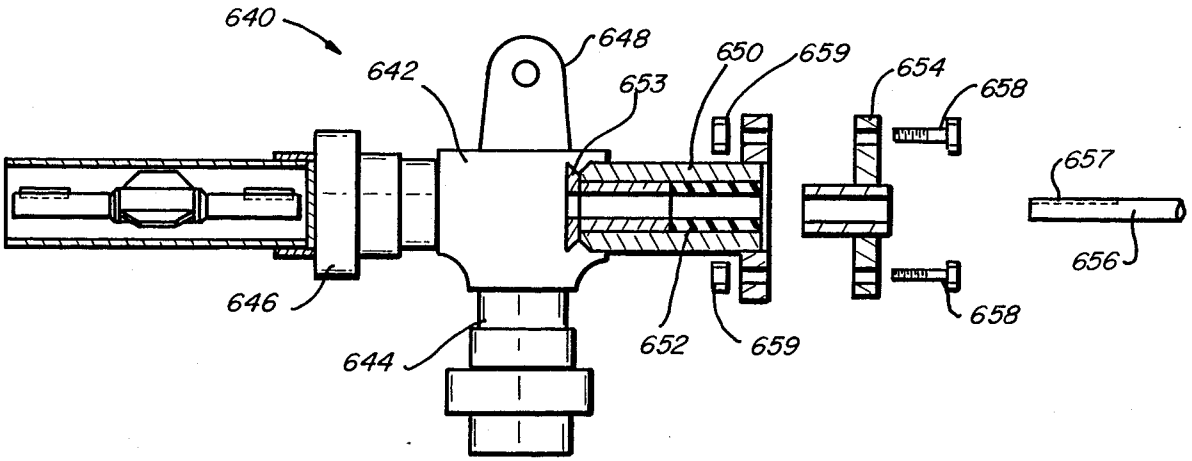
FIG. 8 is a side view, partially in section, of a transition sub of the present invention.

When a multi-joint support pipe means of a desired length has been formed, a transition sub 640 of the type shown in FIG. 8 may be interconnected with the rear most joint of pipe of the multi-joint support pipe means.

Thus, with reference to FIG. 8, the transition sub 640 may comprise, for example, an elbow-jointed tubular casing 642 from which a flanged elbow joint 644 extends. Suitable pipe coupling means are mounted on the front open end of the tubular elbow-joint casing 642 such as a pipe coupling means 646. A pipe support bracket 648 may be provided, if desired, to support the transition sub while it is being positioned. The rear opening of the elbow-joint tubular casing 642 is closed in accordance with the present invention with a high pressure packing gland 650 in which a deformable packing 652 is mounted; the front end of the high pressure tubular packing gland 650 being in bearing engagement with a metal packing ring 653 on which a metal packing gland tube bears. A flanged high pressure packing gland cover plate 654 is used to cover the rear open end of the high pressure tubular packing gland 650. A kelly drive rod 656 is inserted through the opening in the flanged high pressure packing cover tube 654 and the high pressure tubular packing gland 650 through the bore of the elbow-jointed tubular casino 642 and coupled With the rear most kelly rod of the rear most joint of pipe by any suitable means such as a kelly rod coupling pipe 524 of the type shown in FIG. 7. Thereafter, the flanged high pressure packing gland cover plate 654 is secured to the flanges of the flanged high pressure tubular packing gland 650 by any appropriate means such as a plurality of flange bolts 658 which are tightened by means of flange nuts 659.

Returning now to FIG. 10, a gear box 660 is also mounted on the tripping rack frame 602, the gear box 660 containing a drive gear (not shown) and at least one driven reduction gear (not shown) and being provided with indexing power means such as a hydraulic motor 666. The drive gear of the gear box 660 is operatively connected with a coupling rod 668 which, in turn, is operatively interconnected with the kelly drive rod 656 by any suitable means such as a universal coupling 670.

In FIG. 9, the operative interrelationship of the isolation barrel 200 with the crude oil circulator 300 and the transition sub 640 is shown. Turning now to FIG. 9, there may be provided, if desired, a flanged angle pipe 190 mounted on the outside of the gate valve 110 and interconnected with a flanged isolation barrel extension pipe 192 which is in turn connected to an isolation barrel 200 comprising an elongate tubular isolation barrel 202 which is closed at the rear end thereof with a cover plate 204 in which a low pressure packing gland 206 is mounted so as to be in axial alignment with the lateral axes of the flanged angular adjusting pipe 290 and the flanged isolation barrel extension pipe 192.

A deformable packing material 208 is mounted in the flanged low pressure tubular packing gland 206 and a packing ring 210 is positioned adjacent the front end thereof in order to hold the deformable packing material 208 in place. A flanged low pressure packing gland tube 212 is inserted into the flanged low pressure packing gland 206. The circular opening in the flanged low pressure packing gland cover plate 212, the deformable packing 208 and the packing tube 210 are such that a joint of pipe 502 may be inserted therethrough.

After a joint of pipe 502 has been inserted through the flanged low pressure packing gland cover plate 212, the flanges of the cover plate 212 and the packing gland 206 may be operatively interconnected and tightened by any appropriate means such as packing bolts (not shown).

A flanged drain line 214 is provided in the side of the isolation barrel 200 and, at the start of operations, a crude oil circulator 300 is mounted inside the isolation barrel 200 and an initial joint of pipe 502 is connected therewith so as to extend from the interior of the isolation barrel 200 through the flanged tubular packing gland 206.

OPERATION

When a crude oil storage tank 100 containing crude oil and having a significant quantity of hydrocarbon sludge 104 accumulated in the bottom thereof is to be cleaned, a gate valve 110 is mounted on the manway 106 in any appropriate manner, such as for example, by bolting the inner flange of the flanged bore 112 of the gate valve 110 to a manway flange. At the time of installation, the gate valve member 116 will be in a closed position.

A crude oil circulator 300 such as a circulator shown in FIG. 4 is provided. An initial joint of pipe 502 is passed through the low pressure packing gland 206 and coupled to the tubing sub 384. At the time time, the kelly rod 520 of the first joint of pipe will be connected to the kelly 400 in any suitable manner, such as through the use of a kelly rod coupling pipe 524 to which it is keyed by a kelly rod coupling key 530.

The flanges of the flanged isolation barrel 200 can then be jointed with the outer flange of the flanged bore 112 of the gate valve 110 in order to properly position the isolation barrel 200 in the crude oil circulator 300; the isolation barrel being supported in the appropriate position in any suitable manner such as through the provision of isolation barrel support means 202.

In a situation such as that shown in FIG. 2 wherein the manway 106 is positioned significantly above the bottom of the storage tank 100, it may be desirable to insert the crude oil circulator 300 into the storage tank 100 while supported on the multi-joint support pipe means 500 at an angle from the horizontal. In this situation, as shown in FIG. 9, the outer flange of the flange bore of the gate valve 110 may be connected to a flanged angle adjusting pipe 190 to which a flanged isolation barrel extension pipe 192 may, in turn, be bolted; the isolation barrel 200 being secured at its forward flange to the rear flange of the flanged isolation barrel extension pipe 192.

Next, a tripping rack of any appropriate construction such as a tripping rack 600 shown in FIG. 10 may be positioned in lateral axial alignment with the lateral axes of the crude oil circulator 200 and the initial joint of pipe 502 extending through the flanged flow pressure tubular packing gland 206. The tripping rack 600 will be appropriately supported in the desired position by means of a plurality of adjustable tripping rack support means 610, such as four such supports positioned at each of the four corners of the tripping sled 600. With this construction, each of the adjusting collars 616 is fixed to a horizontal pipe rack 606 in any appropriate manner and placed over a corresponding upstanding column 614 and the height is appropriately adjusted by raising or lowering the adjustable collar 616 to align the hole 619 therein with the desired hole 615 in the upstanding column 614 and is secured in place through the insertion of an adjusting pin 617 into the matched holes 615–619.

After the tripping rack 600 has been properly aligned with the isolation barrel 200 and the drain pipe inlet valve 124 has been closed, the turning bar 118 of the gate valve 110 may be rotated in order to raise the gate valve plate 116 and thereby, as shown in FIG. 3, establish fluid communication between the interior of the storage tank 100 and the isolation barrel 200. As a consequence, crude oil will flow into the isolation barrel 200. It will not flow therefrom at this time because the drain pipe inlet valve 124 will be closed, because an initial joint of pipe 502 extending through the flanged low pressure tubular packing gland 206 will prevent crude oil from flowing through the packing gland 206 and because the check ball 356 will be urged against a check ball seat 358 by the check valve spring 352 to prevent crude oil from back flowing through the orifice 362 into the interior of the crude oil circulator 300.

A second joint of pipe 502 may then be taken from the pipe rack 606. The kelly rod 520 of the second joint of pipe 502 is then interconnected with the kelly rod of the first joint of pipe 502 by inserting a kelly key 530 in the kelly rod keyway 522 at the rear end of the first kelly rod and inserting the kelly rod coupling pipe 526 over the rear end of the first kelly rod in alignment so that the rear end of the kelly key 530 is engaged in the kelly rod coupling pipe keyway 526. In like manner, the front end of the second kelly rod will be interconnected by inserting a kelly key 530 in the kelly rod keyway in the front end of the second kelly rod and then inserting the second kelly rod and the second kelly rod coupling key into the coupling pipe 524.

Next, the second joint of pipe 502 is interconnected with the first joint of pipe by stabbing the forward male flush joint pipe thread 510 of the second joint of pipe into the rear female flush joint pipe thread 512 of the first joint of pipe and tightening the joint with any appropriate means such as pipe tongs (not shown).

Next, with reference to FIG. 1, the tripping sled 622 is positioned at the rear of the elongate central slot 604 of the tripping rack frame 602 and the push-pull pipe segment 628 of the push-pull sub 624 of the tripping sled 622, is connected with the second joint of pipe 502 by stabbing a male flush joint pipe thread of the push-pull pipe segment 628 into the rear female flush joint pipe thread 512 of the second pipe joint. After the joint has been tightened by any suitable means, such as, for example, through the use of pipe tongs, the tripping rack power means 630 is actuated to move the top of the endless chain and, hence, the tripping sled 622 in a forward direction towards the crude oil storage tank 100 to thereby progressively partially force the second joint of pipe 502 through the flanged low pressure tubular packing gland 206 of the isolation barrel 200 until only the rear end thereof protrudes. Motion of the sled 622 is then terminated and the push-pull pipe segment is unscrewed from the second pipe joint 502, and moved upward and out of the way by rotation of the push-pull pivot rod 626. The tripping sled 622 is then caused to move to the rear of the elongate central slot 604 by reverse actuation of the tripping rack power means 630 to move the top of the endless chain and, hence, the tripping sled 622, to the rear of the elongate central slot 604.

As a consequence, the crude oil circulator will have moved forwardly from its initial position in the isolation barrel 200 and through, for example, the flanged isolation barrel extension pipe 192 and the flanged angle adjusting pipe 190 into the manway 106.

The pipe tripping operation will then be continued by placing a third joint of pipe 502 on the tripping rack 600 and interconnecting the kelly rod 520 that is rotatably mounted therein at the front end thereof with the rear end of the kelly rod of the second joint of pipe by means of a kelly rod coupling pipe 524 and a kelly rod coupling key 530 interconnecting the rear of the second kelly rod with the kelly rod coupling pipe. In like manner, a kelly rod coupling key 530 inserted in the rear kelly rod coupling pipe keyway is then inserted into the front kelly rod keyway of the third kelly rod and the third kelly rod is inserted into the kelly rod coupling pipe 524. Again, the front end of the third joint of pipe 502 namely, the forward male flush joint pipe thread, is stabbed into the rear female flush joint pipe thread of the second joint of pipe 502 and the joint is made tight by any suitable means such as pipe tongs (not shown) which are used to tightly thread the third joint of pipe 502 at the front end thereof to the rear end of the second joint of pipe 502.

Again, the tripping rack power means 630 is actuated to move the tripping sled 622 in a forward direction and to thereby move the push-pull sub and the third joint of pipe in a forward direction so that the third joint of pipe is partially forced through the flanged low pressure tubular packing gland 206 until only the rear end thereof protrudes. As a consequence, the crude oil circulator 300, now supported on a multi-joint pipe support means is extended into the crude oil storage tank 100. Because the mass of the sled 302 is greater than the combined mass of the tubular housing 310, the agitation means 320 and the connecting means 380, and because the combination just described and the sled can freely rotate about the forward rotatable support bearing 386, the crude oil circulator will remain in an upright position while supported on the multi-joint support pipe means inside the crude oil storage tank 100. Also, by always inserting the kelly rod coupling keys 530 in the kelly rod coupling pipe 526 and the kelly rod keyway 522 with the keyway in an upright (12 o'clock) position, the orientation of the kelly rod 520 with the kelly 400 can be maintained even though the crude oil circulator 300 is now freely rotatably suspended on the multi-joint support pipe means inside the crude oil storage tank 100.

Additional joints of pipe 502 will be added to the multi-joint support means by operation of the tripping rack in the manner described above until a predetermined number of joints of pipe have been added to the multi-joint support pipe means sufficient to position the crude oil circulator 300 adjacent the center of the crude oil storage tank 100.

By utilizing a flanged angle adjusting pipe 190 to offset the isolation barrel 200 at a predetermined angle from the horizontal, the crude oil circulator 300 when it reaches a desired position will be supported on or adjacent the bottom of the crude oil storage tank 100.

Thereafter, and with the tripping sled 622 of the tripping rack 600 moved to the rear thereof and disconnected from the rearmost of the joints of pipe 502, a transition sub 640 will be moved into position on the tripping led 622 by any suitable means such as a travelling hoist (not shown) connected to the transition sub 640 by a hook inserted through the support bracked 648.

When the transition sub 640 has been properly positioned on the tripping rack 620 with the lateral axis of the elbow-jointed tubular casing 642 in alignment with the lateral axis of the joint of pipe 502, a kelly drive rod 656 is inserted through the flanged high pressure tubular packing gland 650 and through the bore of the elbow-jointed tubular casing 642 to proximity with the rear end of the kelly rod 520 of the rear most joint of pipe 502. A kelly rod coupling key 530 is inserted in the rear kelly rod keyway 522 of the kelly rod 520 of the rear most joint of pipe 502 and a kelly rod coupling pipe 524 is mounted on the rear end of the rear most kelly 520 with the kelly rod coupling pipe keyway in engagement with the kelly rod key 530 mounted on the rear most kelly rod 520.

A second kelly rod key 530 is mounted in the rear slot of the kelly rod coupling pipe 524 and the coupling pipe 524 is then inserted over the front end of the kelly drive rod 656 with the kelly rod coupling key engaged in the kelly drive rod keyway 657. The pipe joint coupling means 646 of the elbow-jointed tubular casing 642, will appropriately comprise a male flush joint pipe thread member (now shown) in order to form a fluid tight connection between the rear most joint of pipe 502 and the elbow-joint tubular casing 642.

The kelly drive rod 656 is then interconnected with the coupling rod 668 of the gear box 660 by any suitable means such as a universal coupling 670. Next, and in respect of FIG. 1, a drain line pipe 120 will be fluidly interconnected with the flanged drain line 214 of the isolation barrel 200. The drain line pipe 120 will be fluidly interconnected with the filter inlet line 144 of a suitable filter means 130. Conduit means 160 will be connected at one end thereof with the filter manifold outlet line 150 and the other and thereof will be connected to the suction side of the high pressure pump 170. A pump discharge pipe 180 is interconnected between the discharge side of the high pressure pump 170 and the elbow-joint 644 of the elbow-jointed tubular casing 642. With the drain line inlet valve 124 and the drain line outlet valve 126 open and, for example, the filter inlet line valve 146 and the filter outlet line valve 156 open, the high pressure crude oil pump 170 will be energized. As a consequence, a stream of crude oil will be withdrawn from the storage tank 100 through the manway 106 and gate valve 110 into the flanged adjusting pipe 190 and then into the flanged isolation barrel extension pipe 192. The crude oil will also fill the interior of the isolation barrel 200 and a stream of the crude oil will be withdrawn therefrom through the flanged drain line 214 of the isolation barrel 200 and the drain line pipe 120 into a filter casing 132 of the filter means 130 and will be drawn through the filter screen 136 mounted therein and thence through the filter outlet line 152 to the filter outlet manifold 150 and from thence to pump inlet line 160 and from thence to the suction side of the high pressure pump 170.

Also, the pump discharge pipe 180 is interconnected between the discharge side of the high pressure pump 170 and the elbow-joint 644 of the elbow-jointed tubular casing 642.

Crude oil under pressure is discharged from the high pressure pump means 170 through the pump discharge conduit 180 and through the elbow-joint 644 to the bore of the elbow-jointed tubular casing 642 and from thence through the interior of the tubing sub 384 and the multi-joint support pipe means through the tubular casing 382 of the connecting means 380 to the opening 312 into the interior of the hollow housing 310.

Thereafter, the crude oil under pressure will be forced through the upstanding tubular support segment 318 of the hollow housing 310 into the inner pipe 324 of the rotatable bearing 322 and then through the side port 333 into the interior of the transition pipe 332. The crude oil will then flow through the extension pipe 342, and because of the pressure exerted thereon will unseat the check ball 356 and force it against the pressure of the check valve spring 352 into the angled core 350 of the check valve housing 346. The crude oil will then flow through the check valve bore 348 and out the orifice 362 of the nozzle 360 into the crude oil storage tank 100.

At the same time, the indexing power means 666 will be actuated to rotate a drive gear 662 (not shown) and, more slowly, a reduction driven gear 664 (not shown) so as to rotate the coupling rod 668 and thence through the universal coupling 670 to rotate the kelly drive rod 656. Rotation of the kelly drive rod 656 will, in turn, rotate the interconnected kelly rods 520 of the multi-joint support pipe means 500 which will, in turn, rotate the kelly 400 which will cause the tubular casing 382 to rotate about forward support bearing 386 and rear rotatable support bearing 394. Rotation of the forward support bearing 386 will rotate the flanged bevelled tubular drive gear 410 which will, in turn rotate the flanged bevelled index gear 370. Rotation of the flanged bevelled index gear 370 will cause a corresponding rotation of the connecting pipe collar 330, the transition pipe 332, the extension pipe 342 and the nozzled outlet jets 340.

As indicated earlier, the gear ratios in the gear box 660 should be adjusted so that the nozzled outlet jets 340 will rotate at the rate of about 0.5 to about 4 revolutions per hour. For example, if the indexing power means 666 is a hydraulic motor having a drive shaft rotating at the rate of about 60 revolutions per minute, a gear ratio of about 3,600 to 1 is established between the drive gear and the driven gear, through intermediate driven gears (not shown) if necessary, in order to provide for a gear ratio of about 3,600 to 1 if the nozzled outlet jets are to be rotated at the rate of about 1 revolution per hour.

The high pressure pump 170 will suitably be sized to deliver, for example, from about 2,000 to about 6,000 hydraulic horse power such that crude oil will be ejected from the nozzled outlet jets 340 at a rate of about 1,000 to about 3,000 gallons per minute. The rate of flow will suitably be adjusted to provide for an initial nozzle velocity for the crude oil of about 200 to about 300 feet per second. This will cause the ejected crude oil to be ejected from the nozzle 362 in a highly turbulent dispersion cone which as the cone expands in cross-sectional area will result in a corresponding decrease in the rate of flow of the ejected crude oil such that, however, the rate of flow of the ejected crude oil adjacent the perimeter of the crude oil storage tank 100 will be about 1 to 2 feet per second.

As mentioned earlier, the hydrocarbon sludge 104 or "black sediment and water" that accumulates with time in a crude oil storage tank 100 will be formed by the reversible interaction of asphaltenes, porphryins, condensed ring aromatics, etc., in the crude oil. Thus, the charge transfer forces at the molecular level will cause a reversible coupling of these molecular components to form molecules of a size such that they become solid particles big enough to settle as sludge 104 in the storage tank 100.

However, when the hydrocarbon sludge is impacted with a high velocity jet of crude oil emanating from the nozzles 340 of a crude oil circulator 300 of the present invention, the energy of the ejected crude oil is sufficient to disrupt the charge transfer forces to refragment the hydrocarbon sludge molecule into smaller components that are small enough to be colloidally suspended in or dissolved in the crude oil. Agglomerations of water in the hydrocarbon sludge will likewise tend to be atomized and colloidally suspended in like manner.

The slow rotation of the nozzled outlet jets 340 provides adequate time for the disruption of the charge transfer forces so that the slow rate of rotation actually enhances, rather than impedes the rate at which the hydrocarbon sludge is fragmentized and resuspended in the crude oil.

If the crude oil circulator has been positioned in the crude oil storage tank 100 at an angle, through the use of a flanged angle adjustment pipe 190, so as &:o be on or adjacent the bottom of the storage tank 100, the cone of highly turbulent crude oil ejected from the nozzle 340 will impact upon the bottom of the storage tank 100 so as to insure that all of the hydrocarbon sludge is impacted and fragmentized and resuspended as described above so as to clean the crude oil storage tank of hydrocarbon sludge.

Normally, with the apparatus of the present invention, a crude oil storage tank can be cleaned in a short time such as a matter of 0.5 to 5 days.

When the cleaning operation is complete, if it is desired to remove the cleaning assembly of the present invention, the high pressure pump 170 and the indexing power means 666 will be deenergized and the high pressure pump will be disconnected from the pump inlet line 160 and the pump discharge conduit 180. In like manner, the pump inlet line 160 can be disconnected from the filter manifold outlet line 150 and the pump discharge conduit 180 can be disconnected from the elbow joint 644. Thereafter, and if the filter means is mounted on truck 172 and the high pressure crude oil pump is mounted on a truck 74, the two trucks may be driven from the site.

The valve 124 of the flange drain line 214 will be closed.

Thereafter, the coupling rods 668 will be disconnected from the kelly drive rod 656 after which the pipe joint coupling means 646 of the elbow-jointed tubular casing 642 will be disconnected from the rear most joint of pipe 502 so that the rear most kelly rod 520 can be disconnected from the kelly drive rod 656.

When this has been done, the elbow-jointed tubular casing 642 can be removed from the tripping rack and the push-pull pipe segment of the tripping sled 620 can be repositioned and reconnected with the rear most joint of pipe 502.

The tripping rack power means will then be actuated to move the tripping sled 622 to the rear of the tripping sled 622 thereby withdrawing the rear most joint of pipe 502 from the flanged flow pressure tubular packing gland 206. The rear most joint of pipe 502 is then uncoupled from the next adjacent joint of pipe 502 by any suitable means such as through the use of pipe tongs and the kelly rod 520 of the rear most joint of pipe is disconnected from the kelly rod coupling pipe 524 so that the rear most pipe joint 502 can be removed from the tripping sled 622 and placed in pipe rack 606.

The tripping sled 622 is then moved forwardly along the tripping rack 602 by appropriate activation of the tripping rack power means 630 and the reverse tripping operation is conducted on the next joint of pipe. Reverse tripping is continued until the crude oil circulator is once again positioned inside the isolation barrel 200. When this has been done, the turning bar 118 may be used to lower the gate valve member 116 into the bore of the gate valve 110 to discontinue fluid communication of the crude oil between the crude oil in the storage tank 102 and the crude oil in the isolation tank 200. The remaining crude oil in the storage tank 200 may then be removed therefrom through the drain line 214 after which the isolation barrel 200, the flanged isolation barrel extension pipe 192 and the flanged angle adjusting pipe 190 may be unbolted and removed from the manway 106.

The equipment can then be moved to another location to another crude oil storage tank 100 which is to be cleaned.

Having thus described the invention, what is claimed is:

1. Apparatus useful for dispersing sediment in a storage tank containing a liquid and sediment, said apparatus comprising:

a liquid circulator comprising:

a hollow housing having a front end and a rear end, said housing being closed at the front end thereof and open at the rear end thereof for placement in said storage tank, liquid agitation means including a plurality of nozzled outlet jets laterally rotatably mounted on said housing in fluid communication with the interior of said housing, and connecting means comprising a tubular casing having a front end and a rear end, said tubular casing being mounted at the front end thereof on the open end of said housing, said tubular casing being independently rotatable about its longitudinal axis, said connecting means also comprising casing turning means mounted in said tubular casing and nozzle drive means carried by said tubular casing and operatively connected with said nozzled outlet jets of said liquid agitation means, said apparatus also comprising:

multi-joint support pipe means comprising a plurality of joints of pipe sequentially coupled to each other, each joint of pipe having interconnective turning means rotatably mounted therein and coupled to the interconnective turning means of the next adjacent joints of pipe, the most forward of said joints of pipe being coupled at the front end thereof to the rear end of said tubular casing and the interconnective turning means of said most forward of joints of pipe being operatively coupled to said tubular casing turning means, whereby liquid pump means fluidly interconnected with said multi-joint support pipe means adjacent the rear end thereof for supplying liquid under pressure through said joints of pipe to the interior of said casing, said housing and, thence, to said nozzled outlet jets of said agitation means and whereby indexing power means can be operatively connected with the interconnective turning means of said outermost joint of pipe for rotating said interconnective turning means of said joints of pipe and said casing turning means and, hence, for rotating said nozzled outlet jets at a predetermined rate independent of the pressure and rate of flow of liquid through said nozzled outlet jets.

2. Apparatus as in claim 1 wherein said casing turning means comprises a kelly and said interconnective turning means comprises interconnected kelly rods.

3. Apparatus useful for dispersing sediment in a storage tank containing a liquid and sediment, said apparatus comprising:

a liquid circulator comprising:

a hollow housing having a front end and a rear end, said housing being closed at the front end thereof and open at the rear end thereof for placement in said storage tank, liquid agitation means including a plurality of nozzled outlet jets laterally rotatably mounted on said housing in fluid communication with the interior of said housing, and connecting means comprising a tubular casing having a front end and a rear end, said tubular casing being mounted at the front end thereof on the open end of said housing, said tubular casing being independently rotatable about its longitudinal axis, said connecting means also comprising tubular casing turning means mounted in said casing, and nozzle drive means carried by said casing and operatively connected with said nozzled outlet jets of said liquid agitation means, said apparatus also comprising:

multi-joint support pipe means comprising a plurality of joints of pipe sequentially coupled to each other, each joint of pipe having interconnective turning means rotatably mounted therein and coupled to the interconnective turning means of the next adjacent joints of pipe, the most forward of said joints of pipe being coupled at the front end thereof to the rear end of said tubular casing and the interconnective turning means of said most forward of joints of pipe being operatively coupled to said tubular casing turning means, liquid pump means fluidly interconnected with said multi-joint support pipe means adjacent the rear end thereof for supplying liquid under pressure through said joints of pipe to the interior of said casing, said housing and, thence, to said nozzle and indexing power means can be operatively connected with the interconnective turning means of said outermost joint of pipe for rotating said interconnective turning means and, hence, for rotating said nozzled outlet jets at a predetermined rate independent of the pressure and rate of flow of liquid through said nozzled outlet jets.

4. Apparatus as in claim 3 wherein said casing turning means comprises a kelly and said interconnective turning means comprises interconnected kelly rods.

5. A circulator as in claim 4 wherein:

said hollow housing comprises a lateral barrel segment closed at the front end thereof and an upstanding tubular support segment.

6. A circulator as in claim 4 wherein:

said hollow housing comprises a lateral barrel segment closed at the front end thereof and an upstanding tubular support segment, and said liquid agitation means comprises a tubular base rotatably mounted on said upstanding tubular support segment of said housing, a transition pipe laterally mounted on said tubular base, opposed nozzled outlet jets diametrically mounted on opposite ends of said transition pipe and nozzle turning means for rotating said outlet jets mounted to said transition pipe.

7. A circulator as in claim 6 wherein:

said nozzle turning means of said agitating means is a bevelled indexing gear fixed to the outside of said upstanding tubular support segment, and said nozzle drive means of said connecting means is a bevelled drive gear fixed to the outside of said independently rotatable casing in driving engagement with said bevelled indexing gear.

8. A circulator as in claim 6 wherein:

said nozzle turning means of said agitating means is a turning rod centrally mounted in and to said transition pipe and extending through said port in said transition pipe and the bore of said upstanding tubular support into the interior of said housing, wherein said kelly extends into the lateral barrel segment of said housing, and said nozzle drive means of said connecting means comprises a differential bar rotatably interconnecting said kelly with said turning rod.

9. Apparatus useful for dispersing hydrocarbon sludge in a crude oil storage tank containing crude oil and hydrocarbon sludge, said apparatus comprising:

A liquid circulator comprising:

an elongate sled, a hollow housing pivotally mounted adjacent the front end thereof on said sled adjacent the front end of said sled, said hollow housing comprising a lateral barrel segment closed at the front end thereof and open at the rear end thereof and an upstanding tubular support segment, liquid agitation means comprising a tubular base rotatably mounted on said upstanding tubular support segment of said housing, a transition pipe laterally mounted on said tubular base, opposed nozzled outlet jets diametrically mounted on opposite ends of said transition pipe and nozzle turning means carried by said transition pipe for rotating said outlet jets, and connecting means comprising tubular casing having a front end and a rear end, said tubular casing being mounted at the front end thereof on the open end of said lateral barrel segment, said tubular casing being independently rotatable about its longitudinal axis and in lateral alignment with the longitudinal axis of said barrel of said housing, said connecting means also comprising a kelly mounted in said casing, and nozzle drive means carried by said casing and operatively connected with said nozzle turning means of said liquid agitation means, said nozzle turning means of said agitating means comprises a levelled indexing gear mounted on the outside of said upstanding tubular support segment, and said nozzle drive means of said connecting means comprising a bevelled drive gear fixed to the outside of said independently rotatable casing in driving engagement with said bevelled indexing gear, said apparatus also comprising:

multi-joint support pipe means comprising a plurality of joints of pipe sequentially coupled to each other, each joint of pipe having a kelly rod rotatably mounted therein and coupled to the next adjacent kelly rod, the most forward of joints of pipe being coupled to said kelly, the mass of said sled being greater than the mass of a combination of said hollow housing, said liquid agitation means and said connecting means, whereby the center of gravity of said sled and said combination will be below the aligned lateral axes of said hollow housing and said connecting means, whereby, when sled and said combination are suspended from said multi-joint pipe support means, said sled will be below said combination, hydrocarbon crude oil pump means fluidly interconnected with said multi-joint support pipe means adjacent the rear end thereof for supplying crude oil under pressure through said joints of pipe to the interior of said casing, said housing and, thence, to said nozzled outlet jets, and indexing power means operatively connected with the outermost of said kelly rods for rotating said kelly rods and said kelly to rotate said bevelled drive gear and said bevelled indexing gear to thereby rotate said nozzled outlet jets at a predetermined rate independently of the rate of flow of liquid through said nozzled outlet jets.

10. A crude oil circulator as in claim 9 wherein:

said tubular casing of said connecting means comprises an elongate casing tube, a kelly support spider mounted in said tube, a rotatable support bearing mounted on each end of said casing tube, said forward support bearing being rotatably mounted on said elongate barrel member of said housing in lateral axial alignment with the lateral axis of said barrel member, said bevelled drive gear being circumferentially mounted on said forward support bearing, said connecting means also comprising a tubing sub, said rear support bearing being rotatably mounted on said tubing sub, said tubing sub being coupled to the most forward of said joints of pipe, and said kelly being mounted in said kelly support spider and coupled to said most forward of said kelly rods, whereby rotation of said kelly rods by said indexing power means will rotate said kelly, said kelly support rods, said elongate casing tube, and said bevelled drive gear of said connecting means, and said bevelled indexing gear, said tubular support segment, said transition pipe and said nozzled outlet jets of said liquid agitation means.

11. In a storage tank containing hydrocarbon sludge and crude oil, said storage tank having a diameter of about 100 to about 300 feet, a height of about 20 to about 50 feet, and having a manway in the side thereof, apparatus useful for redispersing said hydrocarbon sludge in said crude oil comprising:

a gate valve mounted on the outside of said storage tank over said manway, an elongate open ended tubular isolation barrel laterally mounted on said gate valve, a cover plate mounted in said isolation barrel adjacent the rear thereof closing the rear end thereof, a tubular packing gland mounted in said cover plate in lateral axial alignment with the lateral axis of said isolation barrel and a drain line mounted on said isolation barrel at the side thereof, a crude oil circulator insertable into said isolation barrel through the open front end thereof, said circulator comprising a hollow housing having a front end and a rear end and closed at the front end thereof and open at the rear end thereof, nozzled liquid agitation means rotatably mounted on said hollow housing and connecting means comprising an independently rotatable elongate casing tube having a front end and a rear end, said casing tube being rotatably mounted at the front end thereof on the rear end of said hollow housing, said connecting means also comprising a tubing sub rotatably mounted on the rear end of said elongate casing tube, casing turning means mounted in said elongate casing tube and nozzle drive means operatively connected to said elongate casing tube and said liquid agitation means for rotating said liquid agitation means on rotatin of said casing, said elongate casing tube and said tubing sub being in lateral axial alignment with the lateral axes of said isolation barrel and said tubular packing gland when said crude oil circulator is in said isolation barrel, multi-joint support pipe means comprising a plurality of sequentially coupled joints of pipe and also comprising interconnective turning means carried by said joints of pipe for rotating said independently rotatable elongate casing tube, the most forward of said joints of pipe being coupled with said tubing sub, filter means fluidly connected with said drain line, high pressure pump means fluidly connected on the suction side thereof with said filter means and fluidly connected on the discharge side thereof with the outermost of said joints of pipe, and indexing power means operatively connected with said interconnective turning means of said multi-joint support pipe means for rotating said nozzle turning means and, hence, through said nozzle drive means of said connecting means, for rotating said agitation means of said crude oil circulator, whereby a stream of crude oil may be removed from said tank through said isolation barrel and said drain line, filtered in said filter means, pressured by said pump means and reinjected into said storage tank through said multi-joint support pipe means and said nozzled jets of said agitation means of said circulator to fragmentize and at least partially redisperse said hydrocarbon sludge in said crude oil.

12. Apparatus as in claim 11 wherein: said crude oil circulator also comprises an elongate sled, wherein said hollow housing is pivotally mounted adjacent the front end thereof on said sled adjacent the front end of said sled, and said hollow housing also comprises a lateral barrel segment closed at the front end thereof and an upstanding tubular support segment.

13. Apparatus as in claim 11 wherein:

said crude oil circulator also comprises an elongate sled, wherein said hollow housing is pivotally mounted adjacent the front end thereof on said sled adjacent the front end of said sled, and said hollow housing also comprises a lateral barrel segment closed at the front end thereof and an upstanding tubular support segment, and wherein said nozzled liquid agitation means of said crude oil circulator comprises:

a tubular base rotatably mounted on said upstanding tubular support segment of said housing, a side-ported transition pipe laterally mounted on said tubular base at the top thereof, opposed nozzled outlet jets diametrically mounted on opposite ends of said transition pipe and nozzle turning means carried by said transition pipe for rotating said outlet jets.

14. A circulator as in claim 13 wherein:

said nozzle turning means of said agitation means comprises a bevelled indexing gear fixed to the outside of said upstanding tubular support segment, and said drive means of said connecting means comprises a bevelled drive gear fixed to the outside of said independently rotatable casing in driving engagement with said bevelled indexing gear.

15. A circulator as in claim 13, wherein:

said nozzle turning means of said agitation means comprises a turning rod centrally mounted in and to said transition pipe and extending through said side port in said transition pipe and the bore of said upstanding tubular support into the interior of said housing, wherein said casing turning means of said connecting means extends into the lateral barrel segment of said housing, and wherein said nozzle drive means also comprises a differential bar rotatably interconnecting said casing turning means with said turning rod.

16. Apparatus as in claim 11 wherein:

said crude oil circulator also comprises an elongate sled, wherein said hollow housing is pivotally mounted adjacent the front end thereof on said sled adjacent the front end of said sled, and said hollow housing also comprises a lateral barrel segment closed at the front end thereof and an upstanding tubular support segment, wherein said liquid agitation means of said crude oil circulator comprises:

a tubular base rotatably mounted on said upstanding tubular support segment of said housing, a side-ported transition pipe laterally mounted on said tubular base at the top thereof, opposed nozzled outlet jets diametrically mounted on opposite ends of said transition pipe and nozzle turning means mounted on said transition pipe for rotating said outlet jets comprising a bevelled indexing gear fixed to the outside of said tubular base, wherein said casing turning means of said connecting means comprises a kelly spider mounted in said independently rotatable casing and a kelly mounted in said kelly spider, said nozzle drive means of said connecting means comprising a bevelled drive gear mounted on the front end of said independently rotatable casing in driving engagement with said bevelled indexing gear of said agitation means, wherein said turning means of said multi-joint pipe means comprises a kelly rod spider mounted in said joint of pipe, a kelly rod rotatably mounted in said kelly rod spider, kelly rod coupling means mounted on and between adjacent kelly rods to interconnect said kelly rods, one of said kelly rod coupling means being mounted on and between the foremost of said kelly rods and said kelly of said connecting means to interconnect said kelly with said interconnected kelly rods.

17. In a crude oil storage tank containing hydrocarbon sludge and crude oil, said storage tank having a diameter of about 100 to about 300 feet, a height of about 20 to about 50 feet, and having a manway in the side thereof, apparatus useful for redispersing said hydrocarbon sludge in said crude oil comprising:

a gate valve mounted on the outside of said storage tank over said manway, an elongate open-ended tubular isolation barrel laterally mounted on said gate valve, a cover plate mounted in and adjacent the rear of said isolation barrel closing the rear end thereof, a tubular packing gland mounted in said cover plate in lateral axial alignment with the lateral axis of said isolation barrel and a drain line mounted on said isolation barrel at the side thereof, a crude oil circulator insertable into said isolation barrel through the open end thereof, said circulator comprising a hollow housing closed at the front end and open at the rear end thereof, nozzled liquid agitation means comprising nozzled outlet jets rotatably mounted on said hollow housing, and connecting means comprising a tubular casing having a front end and a rear end, said tubular casing being mounted at the front end thereof on the open end of said housing, said tubular casing being independently rotatably about its longitudinal axis, said tubular casing having a kelly mounted therein, and also having nozzle drive means carried thereon and operatively connected with said outlet jets of said liquid agitation means, multi-joint support pipe means comprising a plurality of joints of pipe sequentially coupled to each other, each joint of pipe having a kelly rod rotatably mounted therein and coupled to the next adjacent kelly rods, the most forward of said joints of pipe passing through said packing gland and being coupled to the rear end of said tubular casing and the kelly rod of said most forward of joints of pipe being operatively coupled to said kelly, a tripping rack adjacent said storage tank in lateral axial alignment with said isolation barrel, said tripping rack comprising an elongate frame, reciprocation means carried by said frame for movement forward and back along said frame, a tripping sled carried by said reciprocation means, and push-pull coupling means comprising a push-pull sub mounted on said tripping sled for releasably mounting the rearmost of said joints of pipe on said frame, high pressure crude oil pump means fluidly interconnected with said rearmost of said joints of pipe for supplying crude oil under pressure through said joints of pipe to the interior of said tubular casing, said housing and, thence, to said outlet jets, and indexing power means operatively connected with the outermost of said kelly rods for rotating said kelly rods and said kelly, and, hence, for rotating said outlet jets at a predetermined rate independent of the rate of flow of crude oil through said nozzled outlet jets, whereby by simultaneously pumping crude oil through outlet jets of said crude oil circulator and into hydrocarbon sludge in said storage tank while rotating said outlet jets, said hydrocarbon sludge can be redispersed in said crude oil.

18. Apparatus as in claim 17 also comprising:

filter means located outside said storage tank, drain line conduit means fluidly interconnecting said drain line of said isolation barrel with said filter means, and filter conduit means fluidly interconnecting said filter means with the suction side of said pump high pressure crude oil pump means, whereby operation of said high pressure crude oil pump means will cause a stream of crude oil to flow from said storage tank into said isolation barrel, thence through said drain line and said drain line conduit means to said filter means, thence through said filter means and said filter conduit means, and thence through said high pressure crude oil pump means, to said multi-joint support means, said connecting means, said crude oil circulator and said outlet jets back to said crude oil storage tank.

19. Apparatus as in claim 18 wherein said elongate frame of said tripping rack additionally comprises a transition sub:

said transition sub comprising an elbow-jointed elongate tubular casing open at the front end thereof, a high pressure tubular packing gland mounted in and closing the rear end of said elbow-jointed tubular casing, pipe joining means mounted on the front end of said elbow-jointed tubular casing for coupling the rearmost of said joints of pipe of said multi-joint support pipe means to the front end of said elbow-jointed tubular casing, a connecting rod extending through said high pressure packing gland into said elbow-jointed tubular casing and operatively connected to the rearmost of said kelly rods of said multi-joint support pipe means, said indexing power means being operatively coupled to said connecting rod, elbow joint conduit means operatively fluidly connecting said elbow joint with the discharge side of said high pressure pump means whereby said crude oil may be pumped from said pump means through said elbow joint into said elbow-jointed tubular casing and then into said multi-joint pipe support means for delivery to said connecting means, said housing means and said nozzled outlet jets.

20. Apparatus as in claim 19 wherein:

said elongate frame of said tripping rack is a tripping frame having an elongate central slot formed therein and, said tripping frame also comprises frame support means mounted on said frame for supporting said elongate frame in elongate axial alignment with the elongate axes of said isolation barrel and said elongate packing gland, and reciprocating means rotatably mounted in said central slot, tripping rack power means mounted on said frame and operatively connected with said reciprocating means for moving said reciprocating means forwardly and rearwardly in said channel, said tripping sled being operatively connected to said reciprocating means for movement along said frame in response to movement of said reciprocating means and said push-pull sub also comprising a pivot rod vertically pivotally mounted to said tripping sled and a push-pull pipe segment rotatably mounted on said pivot rod for coupling engagement with said rearmost of said joints of pipe of said multi-joint support pipe means.

21. Apparatus as in claim 20 wherein said tripping rack additionally comprises:

a gear box mounted on said elongate frame comprising at least a drive gear and a driven reduction gear operatively connected therewith, a kelly drive rod operatively joining said driven reduction gear with the rearmost kelly rod of said rearmost joint of pipe of said multi-joint support pipe means, and indexing power means mounted on said tripping rack and operatively connected with said drive gear.

* * * * *